US006269743B1

(12) United States Patent
DeMoore et al.

(10) Patent No.: US 6,269,743 B1
(45) **Date of Patent: *Aug. 7, 2001**

(54) VACUUM TRANSFER APPARATUS FOR ROTARY SHEET-FED PRINTING PRESSES

(76) Inventors: Howard W. DeMoore, 10954 Shady Trail, Dallas, TX (US) 75220; Howard C. Secor, 421 Hunters Ridge Cir., Coppell, TX (US) 75019

( * ) Notice: Subject to any disclaimer, the term of this patent is extended or adjusted under 35 U.S.C. 154(b) by 0 days.

This patent is subject to a terminal disclaimer.

(21) Appl. No.: 08/451,121

(22) Filed: May 26, 1995

Related U.S. Application Data

(63) Continuation of application No. 08/034,550, filed on Mar. 19, 1993, now Pat. No. 5,419,254, which is a continuation of application No. 07/636,445, filed on Dec. 31, 1990, now Pat. No. 5,205,217.

(51) Int. Cl.[7] ..... B41F 5/00
(52) U.S. Cl. ..... 101/420; 101/183; 101/231
(58) Field of Search ..... 101/177, 183, 101/231, 232, 419, 420; 271/182, 183, 194, 276, 277

(56) References Cited

U.S. PATENT DOCUMENTS 4,060,238 * 11/1977 Simeth ..... 101/420
4,572,071 * 2/1986 Cappel et al. ..... 101/183
4,819,928 * 4/1989 Osborn et al. ..... 271/276
4,830,355 * 5/1989 Jeschke ..... 271/231
4,957,283 * 9/1990 Kist ..... 271/90
4,997,178 * 3/1991 Ogoda ..... 271/276
4,998,715 * 3/1991 Milan et al. ..... 271/197
5,004,221 * 4/1991 Stark ..... 271/194
5,016,060 * 5/1991 Arai ..... 271/188

FOREIGN PATENT DOCUMENTS 60-191959 9/1985 (JP) .

* cited by examiner

*Primary Examiner*—Ren Yan
(74) *Attorney, Agent, or Firm*—Locke Liddell & Sapp LLP

(57) ABSTRACT

A vacuum assisted sheet transfer assembly has an array of support bars which support the unprinted side of a freshly printed sheet along a sheet transfer path. The support bars overlie the airflow inlet of a manifold housing, with the longitudinal axis of each support bar extending across the sheet transfer path. The support bars provide smooth surfaces for engaging and supporting the unprinted side of the sheet material as it is pulled along the transfer path while simultaneously limiting the flow of inlet air through elongated inlet apertures. As air is drawn through the inlet apertures, the unprinted side of the sheet is sucked into engagement with the support bars as it moves along the sheet transfer path. The sheet transfer assembly eliminates the need for conventional skeleton wheels and the like. Marking, smearing and smudging are prevented since the printed side of the sheet is not handled or contacted in any way as the sheet is conveyed along the sheet transfer path.

22 Claims, 14 Drawing Sheets

VACUUM TRANSFER APPARATUS FOR ROTARY SHEET-FED PRINTING PRESSES

CROSS REFERENCE TO RELATED APPLICATION

This is a continuation of application Ser. No. 08/034,550 filed 03/19/93, now U.S. Pat. No. 5,419,254, issued May 30, 1995 which is a continuation of application Ser. No. 07/636, 445, filed Dec. 31, 1990, now U.S. Pat. No. 5,205,217 issued Apr. 27, 1993.

FIELD OF THE INVENTION

This invention relates generally to printing press equipment, and in particular to anti-marking sheet transfer apparatus for conveying printed sheets between successive stations in a sheet-fed rotary printing press.

BACKGROUND OF THE INVENTION

It has been traditional in the art of sheet-fed printing press machines to provide devices for supporting freshly inked sheet material when transferring the sheet material from one printing station to another or when handling the sheets as they are transferred from the final printing station to a delivery station where the sheets are released and stacked. Typically, a transfer system denotes an apparatus disposed between the several printing stations in the press and which functions to receive a freshly printed sheet from one impression cylinder and move the sheet to the next printing station for additional printing by a further impression cylinder. A delivery system typically denotes an apparatus which receives the freshly printed sheet from the last impression cylinder of the press, and delivers the sheet to the press delivery station, typically a sheet stacker. As used hereinafter, the term transfer is intended to include both apparatus used to transfer a sheet between printing stations of the press and an apparatus used for delivering the sheets to the press delivery stacking station.

In sheet-fed rotary printing presses, it is customary to transfer the sheets from the impression cylinder of one printing station to the impression cylinder of the next by means of one or more successively coacting transfer cylinders, each of which is provided with grippers for engaging the leading edge of the sheet. These cylinders usually are formed with substantially continuous peripheral surfaces for supporting and controlling the body of the sheet during its travel between stations. This transfer apparatus has proven to be effective for transferring sheets in precise registration, but has a tendency to cause the sheets to be marked or smeared.

Marking and smearing of the freshly printed ink occurs as follows. As each sheet is removed from the impression cylinder, and after having received an inked impression, it is immediately conveyed in a reverse curvilinear path with its printed face in contact with the surface of the transfer cylinder. Movement of the sheet is so rapid that the ink on the sheet does not have time to set before it contacts the transfer cylinder surface; consequently, a portion of the ink accumulates on the transfer cylinder surface. As the next sheet and all subsequent sheets are transferred, they may become marked or smeared by the ink accumulation on the cylinder surface.

Marking or smearing of the printed side of the sheet is sometimes caused by fluttering displacement of the sheet as it transfers through the reverse curvilinear path from the impression cylinder to the next transfer cylinder. Slight lateral fluttering in the nip region between the impression cylinder surface and the transfer cylinder surface occurs because of the sudden reversal in the direction of forces acting on the mass of the sheet as it is pulled through the nip region along the reverse curvilinear path. Moreover, the trailing and portion of the wet, printed side of the sheet may be slapped against the transfer cylinder as it is pulled through the nip region. Both the fluttering movement and the tail slap can cause marking or smearing as the freshly imprinted side of the sheet is contacted against the transfer cylinder.

DESCRIPTION OF THE PRIOR ART

Various make-ready methods and devices have been proposed for reducing or eliminating smudges and smears. One such method, for example, involves the use of Emory cloth or the like abrasive material on the surface of the transfer drum to reduce the area of contact with the wet, printed side of the sheet. Other such devices which engage the wet side of the sheet include sawtooth or serrated bands, star wheels, sheets with pointed staples or tacks, whereby the printed side of the sheets are supported at spaced intervals by the respective projecting points.

One of the more common of such devices are wheels of relatively narrow width which have circumferentially spaced teeth. Such devices are known in the trade as "skeleton wheels". The problems inherent in handling freshly inked printed sheets and the like by skeleton wheels have been longstanding. Typically, a set of grippers pulls a printed sheet from an adjacent printing station across a rotating set of as many as seven or more skeleton wheels for subsequent stacking and delivery. The sheet is subjected to high tension and stresses as it is pulled by the grippers, and the skeleton wheels support the sheet to prevent it from buckling or warping. The freshly printed, undried sheets present their wet, inked surface to the skeleton wheels, and this contact between the inked surface and wheels has been a continuing source of marking problems.

Marking occurs as ink is deposited from each sheet onto the skeleton wheels and is subsequently transferred from the skeleton wheels to succeeding sheets. In addition, if the peripheral sheet contacting surface of the skeleton wheels is traveling at a different speed relative to the sheet, then it is likely that the inked sheet will be smeared. The problem is particularly acute in conventional high speed presses which have high output, for example, from 4,000 to 18,000 sheets per hour. In any event, marked sheets must be rejected and the job run again, resulting in additional expense and delay.

There have been a variety of expedients developed in attempts to overcome the skeleton wheel marking problem, the attempts typically being directed toward minimizing the amount of surface area contact between the inked areas of each sheet and the skeleton wheels. In general, however, it is evident that a reduction in contact area between the skeleton wheels and the printed surface correspondingly reduces the amount of support provided for each sheet by the skeleton wheels. As a result, these prior attempts have not been satisfactory.

In one such prior art arrangement, the skeleton wheels are in the form of thin discs having a fluted or serrated circumference presenting a series of very narrow, curved projections for engaging and supporting the printed side of the sheet. However, these projections still mark and smear the printed surface as previously described. Moreover, the force of the narrow projections against the sheet often produces a corresponding series of concave depressions along the sheet.

The depressions alone mar the printing job, and also further cause "fan out" of the sheet and prevent accurate registration. In a "fan out" condition, the depressions cause slight changes in the dimensions of the sheet. If the sheet is to be run through a press a second time, as is often the case in multicolor jobs, it must be in precise registration or else the second printing will be blurred. "Fan out" from the skeleton wheel depressions causes misregistration.

Various efforts have been made to overcome the limitations of thin disc skeleton wheels. One of the more successful approaches has been completely contrary to the concept of minimizing the surface area contact. This more successful approach is disclosed and claimed by Howard W. DeMoore in U.S. Pat. No. 3,791,644 entitled "Sheet Handling Apparatus" wherein a substantially cylindrical drum or cylinder is coated with an improved ink repellent surface comprising a layer of polytetrafluoroethylene. Although this improved transfer cylinder has been commercially successful, under continuous use conditions such as is common in many commercial printing operations, there is over a period of time a slight accumulation of ink on the surface of the transfer cylinder which must be removed.

In high speed commercial printing equipment, for example, it has been determined that in order to provide satisfactory printing quality, the surface of the coated transfer cylinder must be washed occasionally with a solvent to remove ink accumulation. Moreover, it has also been determined that the TFE coated cylinders do not provide a cushioning effect which is important for the tightly stretched sheet material as it engages and is supported by the transfer cylinder.

The problems inherent in the thin disc and other prior skeleton wheel concepts have been overcome with a skeleton wheel of relatively great width and with an improved ink repellent and continuous supporting surface which may be used in conjunction with the teachings of U.S. Pat. No. 3,791,644 as well as in conjunction with further improvements which have been made in apparatus for supporting and handling freshly inked sheet material. This more recent improvements are disclosed and claimed by Howard W. DeMoore in U.S. Pat. No. 4,402,267 entitled "Method and Apparatus for Handling Printed Sheet Material" wherein the freshly printed side of the sheet material is supported by a loose woven fabric covering which is mounted onto the cylindrical surface of a transfer cylinder. The fabric covering for the transfer cylinder includes a lightweight material such as cotton fabric or the like which is treated with a suitable ink repellent material having low friction characteristics, for example, a fluoroplastic. The fabric covering is loosely supported on the surface of the transfer cylinder to accommodate any slight relative movement between the sheet material and the transfer cylinder surface without marring or otherwise smudging the freshly inked surface. To further reduce frictional engagement, the supporting surface of the transfer cylinder includes a low friction fluoropolymer layer as taught in U.S. Pat. No. 3,791,644.

The foregoing loosely retained, ink repellent fabric covering arrangement has proven to be highly successful and has gained worldwide acceptance. Nevertheless, the fabric covering engages the freshly printed side of the sheet material, and gradually accumulates ink after prolonged use. As the ink accumulates over a long period of time, it causes the fabric covering to sag in certain areas, to become too loose or too tight, tears or becomes worn, and becomes relatively stiff in other areas. Moreover, the ink accumulation tends to form surface projections which smear the freshly printed sheet. After long continued operation, the ink may build up sufficiently that the fabric covering loses its elasticity. Unless the press is stopped periodically to remove and replace the woven covering, smudging and smearing may occur. While the fabric net can be replaced relatively quickly, replacement of the net still requires that the press be shut down, thereby resulting in periodic press down time.

In addition to U.S. Pat. No. 3,791,644 and U.S. Pat. No. 4,402,267 discussed above, the following U.S. patents disclose examples of prior art sheet handling apparatus for conveying printed sheets between successive printing stations in a sheet-fed rotary printing press:

- U.S. Pat. No. 2,730,950—"Air Pressure System for the Skeleton Wheels of an Off-Set Printing Press", Grassi.
- U.S. Pat. No. 2,933,039—"Sheet Transferring Mechanism", Claybourn et al.
- U.S. Pat. No. 3,542,358—"Sheet Drum for a Sheet Printing Press", Schuhman.
- U.S. Pat. No. 4,015,522—"Multicolor Sheet-Fed Printing Press", Preuss et al.
- U.S. Pat. No. 4,085,930—"Sheet Delivery Mechanism for Sheet-Fed Printing Machines", Weisgerber et al.
- U.S. Pat. No. 4,203,361—"Sheet-Fed Rotary Printing Machine", Pollich.
- U.S. Pat. No. 4,222,326—"Mechanism for Controlling and Smoothing A Conveyed Sheet", Mathes et al.
- U.S. Pat. No. 4,395,949—"Sheet Transport Drum Assembly in a Rotary Printing Press", Jeschke.
- U.S. Pat. No. 4,413,562—"Chain-Type Transport Apparatus for Use With Printing Machines", Fischer.
- U.S. Pat. No. 4,479,645—"Sheet Deliverer for Rotary Printing Machines", Pollich.
- U.S. Pat. No. 4,552,069—"Smear-Free Transfer Cylinder for Sheet-Fed Rotary Printing Machines", Jahn.
- U.S. Pat. No. 4,572,071—"Device for Guiding Sheets Printed on One or Both Sides", Cappel et al.
- U.S. Pat. No. 4,572,073—"Sheet Guide Arrangement in Sheet-Fed Machines", Mitze et al.
- U.S. Pat. No. 4,688,784—"Covering for Sheet-Supporting Cylinders and Drums in Rotary Offset Printing Presses", Wirz.
- U.S. Pat. No. 4,735,142—"Sheet Transfer Drum", Haupenthal.
- U.S. Pat. No. 4,815,379—"Sheet Transfer Cylinder Between Printing Units of a Rotary Printing Machine", Becker et al.
- U.S. Pat. No. 4,836,104—"Sheet Transfer Mechanism for a Freshly Printed Sheet", Duarte.

It will be appreciated that the foregoing prior art devices have involved contacting the "wet" side of the printed sheet, and the smearing and smudging problems are directly attributable to contacting the freshly printed surface.

In many printing applications, only one side of the sheet receives ink from the blanket cylinders during each pass through the printing press. It has been determined that in those situations where only one side of the sheet is to be printed, use of a transfer system which engages and supports the printed (wet) side of the sheet may be unnecessary and a transfer system can be used which engages and supports the nonprinted (dry) side of the sheet. For example, in non-perfector type printing presses, only one side of the sheet is printed during each pass through the press. In such presses, conventional transfer systems which support and engage the printed side of the sheet can be eliminated, and a transfer system which engages and supports only the nonprinted side of the sheet can be used.

In U.S. Pat. No. 2,933,039 issued Apr. 19, 1960 to Clayborn et al., entitled "SHEET TRANSFERRING MECHANISM", there is disclosed a transfer system for preventing sheet marking and which is intended to be a substitute for conventional transfer apparatus which engage and support the printed side of the sheet. That patent discloses a stationary curved sheet guide having a solid surface mounted adjacent to the path of the sheet transfer grippers and which supports the nonprinted side of a freshly printed sheet as it is pulled by the grippers from the impression cylinder. As discussed in that patent, provision is made for creating a negative pressure between the sheet and the solid surface of the sheet guide so that the sheet is drawn into engagement with the sheet guide as it is pulled by the grippers from the impression cylinder.

In U.S. Pat. No. 4,572,071 issued Feb. 25, 1986 to Cappel et al., entitled "DEVICE FOR GUIDING SHEET PRINTED ON ONE OR BOTH SIDE", there is disclosed an improvement over the foregoing Clayborn et al. patent, and which suggests employing a stationary curved sheet guide having an apertured solid support surface through which air can be drawn to create a negative pressure on the sheet, thereby to draw the nonprinted side of the sheet against the sheet guide. In this respect, this patent suggests that the sheet guide be formed as the surface of a plenum chamber coupled to a plurality of fans which can be selectively operated to either provide a negative pressure within the plenum chamber, or a positive pressure within the chamber such that the sheet can, respectively, be either drawn against the surface of the sheet guide in the case of single sided printing, or "floated" above the surface of the sheet guide in the case of two sided printing.

Applicants have found that use of stationary sheet guide apparatus of the type disclosed in the Clayborn et al. and Cappel et al. patents, wherein the sheet is drawn onto and pulled against the substantially continuous, solid support surface of the sheet guide may result in the sheet being pulled partially or fully from the transfer grippers due to the high frictional force created between the sheet and the substantially continuous supporting surface of the sheet guide, thereby resulting in sheet misalignment and misregistration for subsequent printing units.

OBJECTS OF THE INVENTION

Accordingly, the general object of this invention is to provide an improved sheet transfer apparatus for an offset printing press with vacuum assisting means for positively preventing streaking, smudging or smearing the printed side of the sheet as the sheet is being transferred to or from an impression cylinder.

Another object of the invention is to provide an antimarking sheet transfer apparatus which utilizes minimum surface contact components for guiding and supporting the unprinted surface of a freshly printed sheet as it is transferred from one printing station to another.

Yet another object of the present invention is to provide a vacuum assisted sheet transfer apparatus for transferring sheet material from one printing station to another in which the sheet material is guided and support closely to the vacuum transfer apparatus, thereby reducing suction air flow requirements.

A related object of this invention is to provide sheet transfer apparatus of the character described in which frictional engagement and drag between the sheet and the support components is minimized.

As will become more apparent hereinafter, the present invention provides a new and improved transfer apparatus for supporting the nonprinted side of a sheet which achieves the foregoing objects in a novel and unobvious manner.

SUMMARY OF THE INVENTION

The present invention provides a new and improved vacuum transfer apparatus for conveying freshly printed sheets between processing stations within a printing press by supporting the sheets on the nonprinted side in such a manner as to insure that precise sheet registration is maintained. The apparatus of the invention utilizes minimum surface contact support components which are relatively inexpensive to manufacture, highly reliable in use, and can be readily installed in existing presses as a replacement for conventional sheet transfer apparatus, or an alternative sheet transfer system usable when single-sided sheet printing is being made.

In accordance with one aspect of the present invention, the vacuum transfer apparatus includes an arcuate array of elongated guide support bars adapted to engage and support the nonprinted side of a freshly printed sheet as it is moved from the impression cylinder along the transfer path. The guide support bars are mounted onto a frame in side-by-side spaced relation, and are arrayed to extend laterally across the transfer path. The frame on which the guide support bars are mounted has substantially closed side panels and forms a vacuum chamber with the support bars overlying face of the chamber adjacent the transfer path. The vacuum chamber formed by the frame and support bars is coupled to a vacuum producing source such as a fan or suction pump for creating a negative pressure within the chamber to pull air into the chamber between the spaced support bars. As air is pulled through the space between the support bars into the vacuum chamber, the nonprinted side of a freshly printed sheet is drawn into engagement with the support bars which guide and support the sheet as it is pulled along the transfer path. In this manner, frictional engagement between the sheet and the curved surfaces of the support bars is substantially reduced, thereby reducing the area of frictional engagement and insuring that the sheet is not pulled from the transfer grippers so as to destroy sheet registration.

In the preferred embodiment, the manifold airflow inlet opening is concave, and the curved external surfaces of the guide support bars provide a smooth, concave sheet transfer path whereby the dry, unprinted side of the sheet material is pulled against the curved surface of the spaced guide bars as the sheet moves along the sheet transfer path. Consequently, it is unnecessary to handle the wet, freshly printed side in any way, thereby completely avoiding contacting engagement with the freshly printed side which would otherwise cause marking or smearing.

According to another aspect of the invention, differential airflow gradients are formed along the transport path by a first arcuate section of guide support bars which have relatively large aperture spacing, thereby producing a series of elongated inlet apertures of relatively large inlet flow areas extending across the manifold airflow inlet opening in that section, and by a second arcuate section of guide support bars which have relatively small aperture spacing. According to this construction, a relatively stronger suction force is applied to the gripper edge portion of the sheet material as it is pulled along the sheet transfer path, and a larger airflow volume is produced adjacent the leading edge of the transfer apparatus to facilitate initial sheet redirection or "sheet break" as it leaves the impression cylinder.

The suction force stabilizes the sheet against wrinkling and surface distortions which might otherwise be caused by fluttering displacement of the sheet as it is transferred through the nip region between an impression cylinder and a transfer cylinder. Moreover, the unprinted side of the trailing end portion of the sheet is pulled by the suction force against the support bar assembly, thereby avoiding tail slap against the transfer cylinder and the marking attendant therewith. The differential airflow gradient is increased by partitioning the inlet air manifold and increasing the airflow rate through the large aperture section.

BRIEF DESCRIPTION OF THE DRAWINGS

The present invention will be understood and appreciated by those skilled in the art upon reading the detailed description which follows with reference to the attached drawings, wherein.

DETAILED DESCRIPTION OF THE PREFERRED EMBODIMENTS

Figure 1:
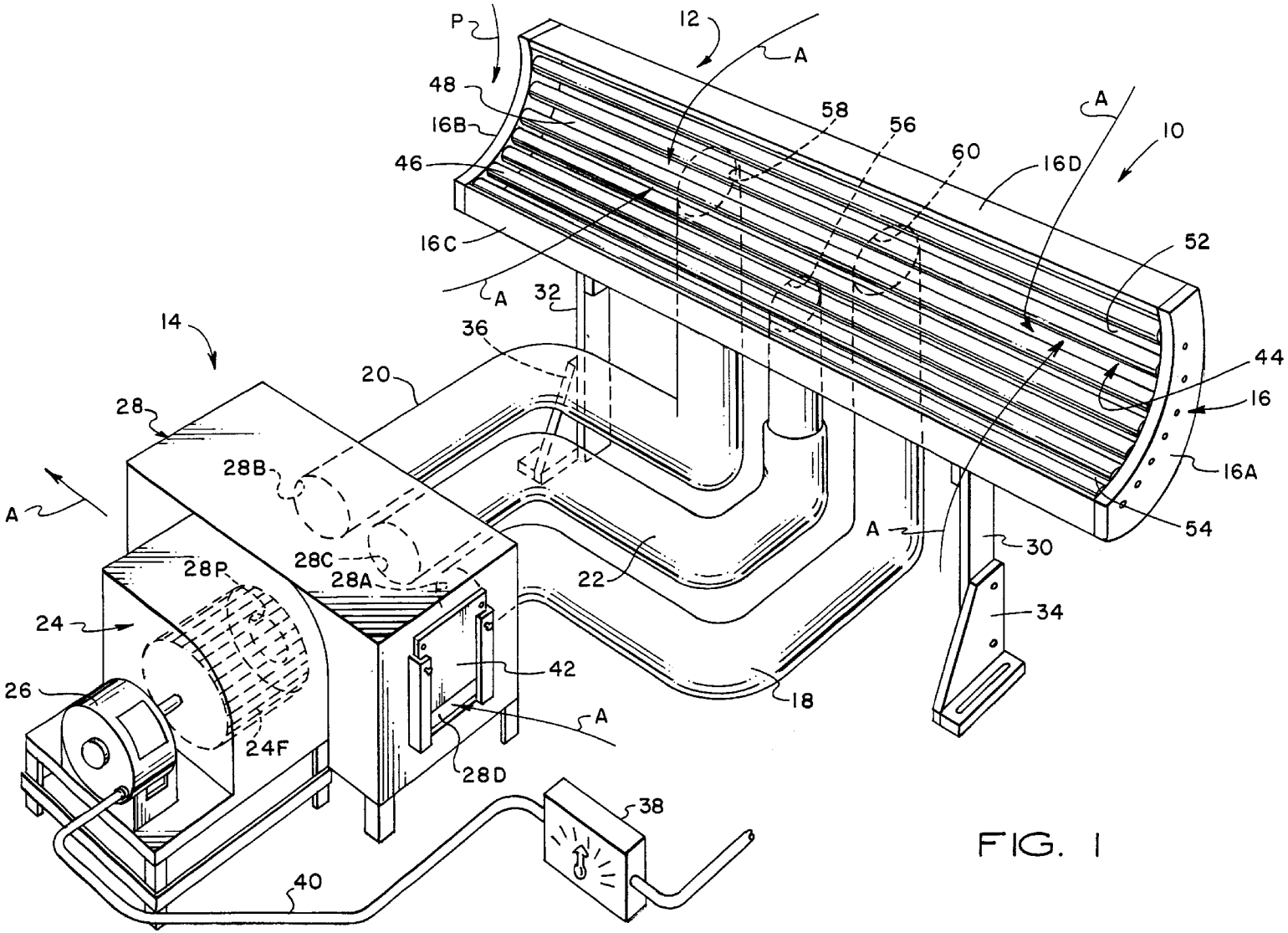
FIG. 1 is a perspective view of a vacuum assisted, non-rotational anti-marking sheet transfer system constructed according to the teachings of the present invention.

In the description which follows, like parts are marked throughout the specification and drawings with the same reference numerals, respectively. The drawing figures are not necessarily drawn to scale and the proportions of certain parts have been exaggerated for purposes of clarity.

At the outset, it should be understood that the vacuum assisted, minimal surface contact anti-marking sheet transfer system 10 of the present invention is designed to completely replace conventional skeleton wheels, the sheet handling roller of U.S. Pat. No. 3,791,644 and the sheet handling apparatus as disclosed in U.S. Pat. No. 4,402,267. On a functional basis, the anti-marking sheet transfer system 10 as shown in FIG. 1 is effective for conveying sheet material from one printing station to another, but without engaging, contacting or otherwise handling the wet (printed) side of sheet material as it is conveyed through a multicolor rotary printing press which may include as many as seven or more printing stations for printing a corresponding number of color impressions upon sheets of material conveyed therethrough.

Figure 2:
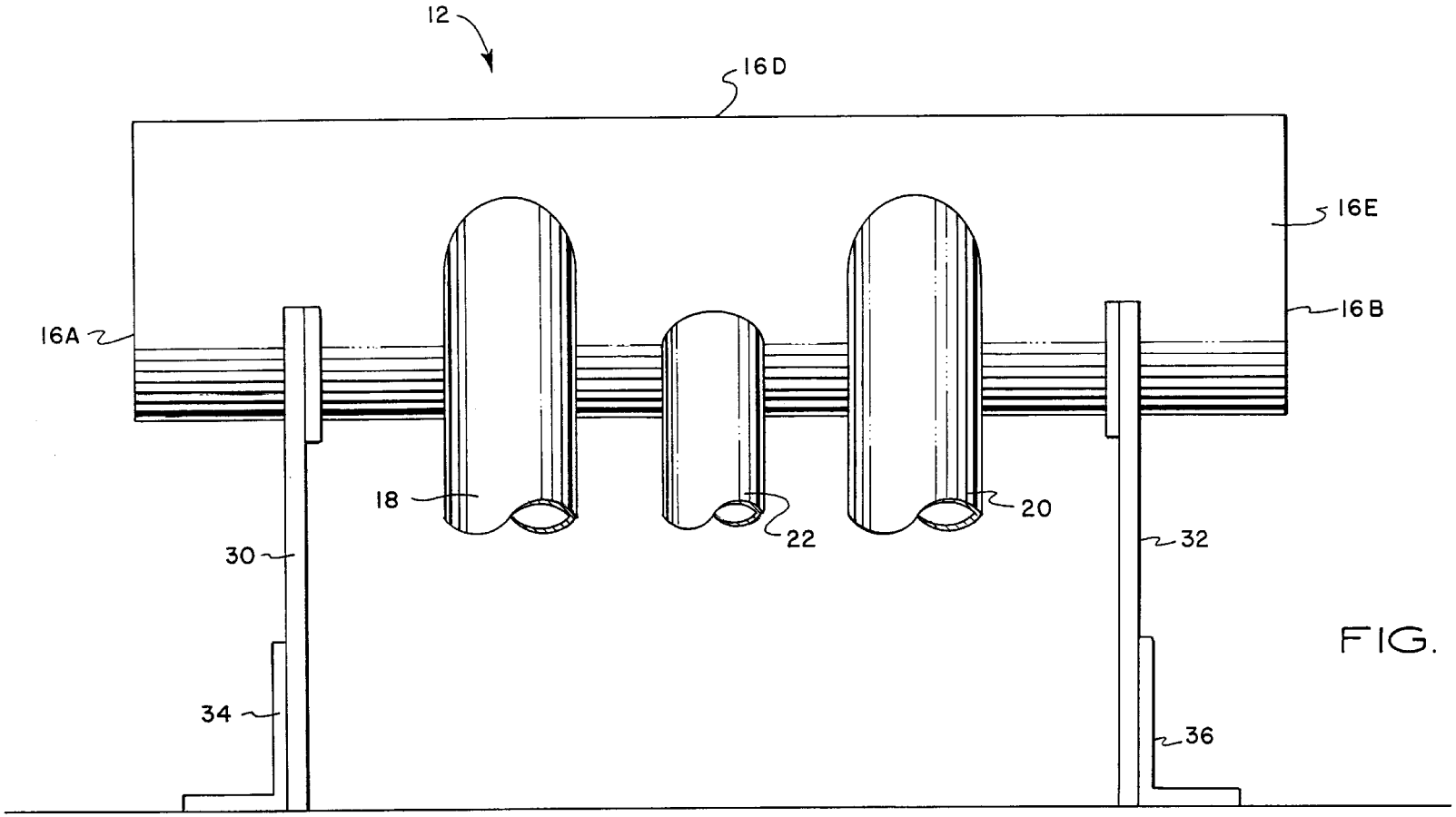
FIG. 2 is a rear perspective view of the air manifold housing shown in FIG. 1.

Referring now to FIGS. 1 and FIG. 2, the antimarking sheet transfer system 10 of the present invention includes a guide support bar assembly 12 and a vacuum source 14. The guide support bar assembly 12 includes an air suction manifold housing 16 which is coupled in airflow communication with the vacuum source 14 by suction air ducts 18, 20 and 22. The vacuum source 14 includes a suction fan assembly 24 having a squirrel cage suction fan 24F which is mechanically driven by an induction motor 26. The suction air ducts 18, 20 and 22 are connected to a suction air manifold 28 at inlet ports 28A, 28B and 28C, respectively. The suction fan assembly 24 is coupled to the outlet port 28P of the suction air manifold 28, whereby ambient air indicated by the arrow A is drawn through the support bar assembly 12 into the suction air ducts 18, 20 and 22, and thereafter through the suction air manifold 28, for discharge by the suction fan assembly 24.

The support bar assembly 12 is supported upright by stanchions 30, 32 which include foundation brackets 34, 36, respectively, for anchoring the assembly 12 onto the printing press frame or onto the floor beneath the printing press.

The induction motor 26 is electrically connected to a source of electrical power through a variable speed controller 38 by a power conductor cable 40. The running speed of the induction motor 26 is manually adjustable by the press operator to produce a desired airflow rate through the support bar assembly 12. Operator control of the suction airflow is also manually adjustable by opening and closing a vent plate 42 which is slidably mounted onto a side panel of the suction air manifold 28. The position of the vent plate 42 is adjustable for enlarging and reducing the inlet area of a by-pass inlet port 28D which increases and reduces the airflow through the air ducts 18, 20 and 22 as the by-pass inlet port 28D is enlarged or reduced by extending or retracting the vent plate 42. Although manual control means are illustrated, the system can be automatically controlled if desired.

Referring now to FIG. 1 and FIG. 2, the support bar manifold housing 16 is an assembly of side panels 16A, 16B, a front panel 16C, a top panel 16D and a semicylindrical back panel 16E. The side panels 16A, 16B have curved edge portions onto which the semicylindrical back panel 16E is attached. The panel assembly defines a manifold housing having a concave airflow inlet opening 44, which conforms closely with an arcuate sheet transfer path P.

According to a first embodiment of the invention, as illustrated in FIGS. 1, 2, 3, 5 and 6, the support bar assembly 12 includes an array of guide support bars 46 mounted onto the side panels 16A, 16B across the airflow inlet 44, thereby defining a curved sheet transfer path P. The guide support bars 46 are spaced along the curved sheet transfer path P thereby defining a plurality of elongated inlet apertures 48. According to this arrangement, the external surfaces of the guide support bars 46 provide smooth surfaces for supporting and guiding the unprinted side of the sheet material along the curved transport path while simultaneously constraining and limiting the flow of inlet air into the manifold housing 16 through the inlet apertures 48.

The arcuate array 12 of guide support bars 46 is disposed along the curved transfer path P to engage and support the nonprinted side of a freshly printed sheet in such a manner to insure that excessive frictional engagement of the sheet does not occur, and that sheet registration is maintained. The vacuum transfer apparatus 10 of the invention is relatively inexpensive to manufacture, highly reliable in use, and can be readily installed in most conventional presses without requiring modification.

Toward the foregoing ends, the guide support bars 46 are rigidly attached to the manifold housing side plates 16A, 16B and arrayed to extend side-by-side in spaced, parallel relation laterally across substantially the full width of the transfer path P. In this instance, the manifold housing 16 forms an internal vacuum chamber 50 enclosed by the front and top panels 16C, 16D, respectively, the laterally spaced side panels 16A, 16B and the semi-cylindrical rear panel 16E. Each of the side panels has an arcuate shape corresponding to the arc of curvature of the transfer path P, and the guide support bars 46 are mounted to the side panels opposite the rear panel 16E so that the support bars overlie the vacuum chamber 50 and form an arcuate path corresponding to that of the curved transfer path P.

According to one aspect of the invention, a group of guide support bars 46 are relatively widely spaced along the upper chamber section 50B of the concave airflow inlet opening 44, thereby producing a series of elongated inlet apertures 52 which have relatively larger aperture inlet flow areas as compared to the corresponding inlet flow apertures 54 defined between the more closely spaced support bars 46 in the lower chamber section 50A. Accordingly, a greater volume of air can be drawn through the upper suction zone provided by the widely spaced bars 46, thereby compensating for leakage and developing an adequate suction force for application to the leading edge portion of the sheet material as it is pulled along the curved transfer path P.

The differential airflow gradient is increased by partitioning the lower support bar manifold chamber 50A with respect to the upper manifold chamber SOB. A partition panel 16P extends longitudinally across the length of the manifold housing 16, thereby separating the two chambers 50A, 50B. Moreover, the lower manifold chamber 50A has a suction port 56 coupled to the suction air duct 22 which is isolated with respect to the upper manifold chamber 50B. The upper manifold chamber 50B has dual suction ports 58, 60 which are coupled to the suction air manifold 28 by the suction air ducts 18, 20, respectively. The larger suction ports 58, 60 are isolated with respect to the lower manifold chamber 50A, and are connected in airflow communication with the upper manifold chamber 50B through the rear semicylindrical panel 16E.

According to the foregoing arrangement, airflow through the large apertures 52 is substantially increased relative to the airflow through the smaller apertures 54 in the lower chamber section by the dual suction ports 56, 58 and the dual suction air ducts 18, 20 which more than double the rate of airflow through the support bars in the upper chamber section 50B relative to the lower support bar chamber section 50A.

The smooth support provided by the curved support bars 46 stabilizes the sheet against wrinkling and surface distortions which might otherwise be caused by fluttering displacement of the sheet material as it is transferred through the nip region between an impression cylinder and a transfer cylinder. The increased airflow provides sufficient suction to pull the leading edge of the sheet against the guide support bar assembly along the curved transfer path P. Otherwise, the sheet will be pulled straight, and will not transfer properly. Moreover, the unprinted side of the trailing end portion of the sheet is pulled by the suction force against the support bars 46, thereby avoiding tail slap and marking.

Initially, only the leading edge of the sheet material is gripped by the rotary grippers, and the leading edge is the only section of the sheet which is exposed to the guide support bars and suction force. Consequently, a stronger force is initially required to handle the sheet, as compared to the force required after the sheet has been advanced along the transfer path where there is a much larger sheet area being handled by the suction force developed through the apertures 54 between the more closely spaced support bars 46.

Figure 3:
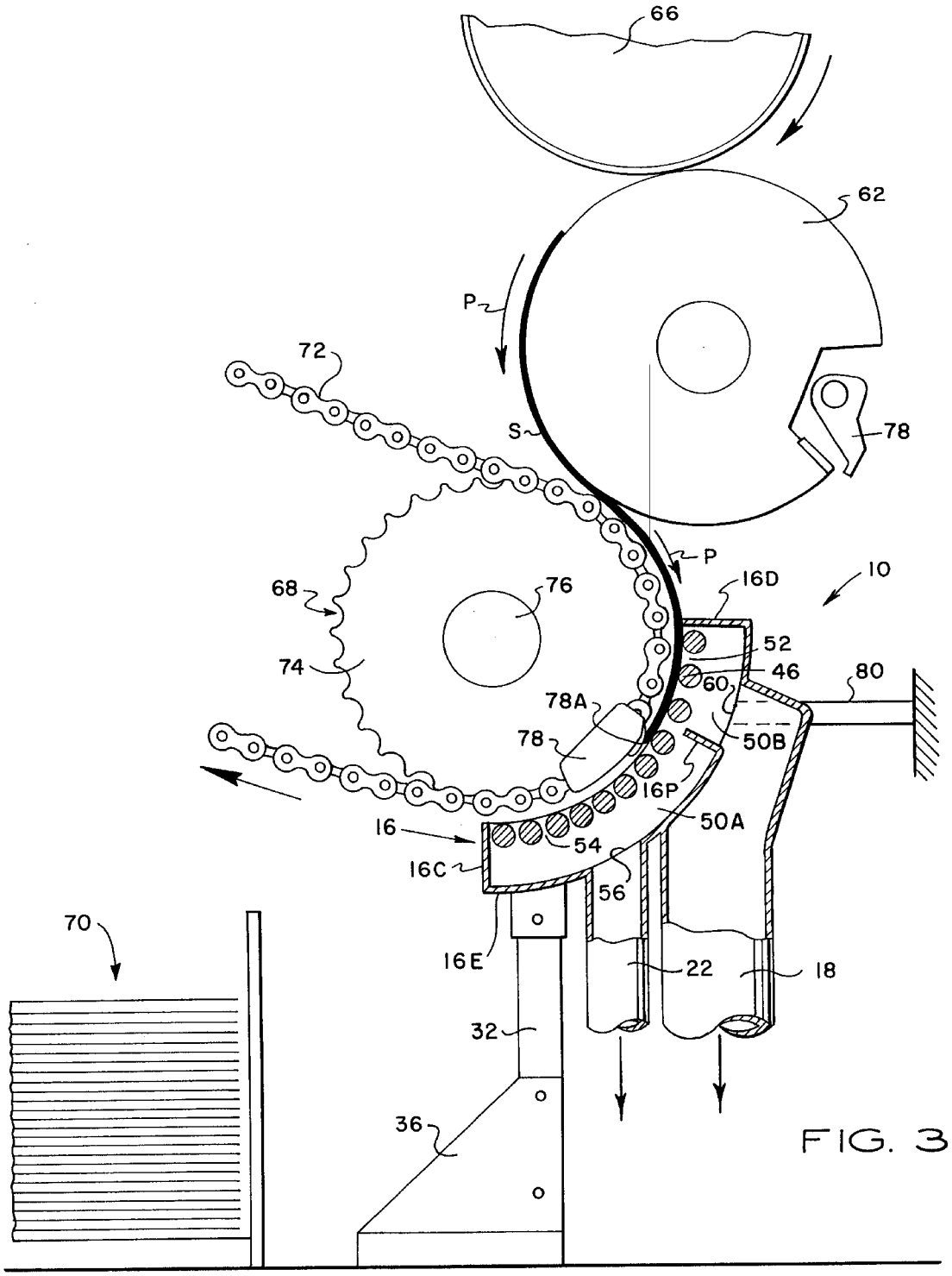
FIG. 3 is a side elevational view which illustrates the installation of the sheet transfer assembly of the present invention installed between the last printing station and the delivery station of the printing press shown in FIG. 3.

In the exemplary embodiment illustrated in FIG. 1 and FIG. 3, the two six inch diameter suction ducts 18, 20 connect into the upper manifold chamber 50B which defines the relatively strong suction zone and there is one five inch diameter duct 22 connected to the lower manifold chamber 50A. There is sufficient air pressure differential above the guide support bar assembly 12 that the unsupported section of the sheet is pulled outwardly and generally assumes the form of a cylindrical surface in the supported region.

In the exemplary embodiment of FIG. 1, the manifold inlet area defined by the concave surface of revolution area is 41 inches wide by an arc length of approximately 9-½ inches which yields approximately 390 square inches effective overall inlet area. The total effective aperture area is considerably smaller, with the leading edge of the upper manifold zone 50B having dimensions of approximately 41 inches wide by 3 inches arc length, with the aperture spacing of approximately ⅛ inch between the support bars 46 in the upper zone 50B yielding an effective aperture area of approximately 30 square inches. The total surface aperture area of the lower support bar section is 41 inches wide by approximately 6-½ inches arc length by approximately 1/16 inch spacing, which yields approximately 20 square inches effective inlet area.

Overall, by adding the two zones together, the total effective aperture inlet area is approximately 50 square inches. With the apertures in the lower and upper zones open, the airflow is approximately 1,900 cubic feet per minute at ¾ inch static pressure. When a sheet is completely in an overlay position across both suction zones, the airflow rate drops to approximately 350 cubic feet per minute at 2 inches static pressure. The flow rate does not drop to zero because there are small openings along the marginal edges through which air is drawn. When the support bar assembly is completely open, the velocity of air through the apertures is approximately 5,500 feet per minute.

As a result of the creation of a negative or vacuum pressure within the chamber 50, air is drawn into the chamber through the apertures 48 between the support bars 46. This airflow creates a suction force along the transfer path P which will cause a sheet being pulled from an impression cylinder by the transfer conveyor to be drawn into engagement with the curved support surfaces of the support bars 46. Preferably, the support bars 46 are rigidly mounted to the side panels 16A, 16B such that the curved supporting surfaces of the bars lie along the transfer path P or very sightly spaced radially outwardly therefrom (that is, toward the vacuum transfer apparatus) so that as a sheet is supported and conveyed along the support bars, the grippers can pass over the support bars and the sheet will not engage any other apparatus in the press, including any conventional transfer system components that may be present. Thus, the printed side of the sheet will be maintained out of contact with any other apparatus, and can not possibly be marked, smeared or otherwise marred during the transfer.

Referring again to FIG. 3, the vacuum transfer apparatus 10 is primarily intended for use in a sheet fed, offset rotary printing press of conventional design, to engage and support the nonprinted side of a freshly printed sheet S as it is moved from an impression cylinder 62 of the press to a further processing station within the press. In this instance, sheets S to be printed are pulled by sheet grippers 78 attached to the impression cylinder 62 through the nip between the impression cylinder 62 and a blanket cylinder 66 where ink is applied to one side of the sheet. After ink has been applied to the printed face of the sheet S, a transfer conveyor 68 grips the leading edge of the sheet at the impression cylinder 62, and pulls the sheet from the impression cylinder, around the transfer apparatus 10, and then to a delivery stacking station 70 within the press.

Herein, the transfer conveyor 68, which is also of conventional design, comprises a pair of endless chains 72 (only one of which is shown) entrained about sprocket wheels 74 laterally disposed on each side of the press and centrally supported by a drive shaft 76. Extending laterally across the endless chains 72 at spaced intervals are sheet gripper assemblies 78 carrying a plurality of conventional sheet grippers 78A which operate to grip the leading edge of the sheet S at the impression cylinder 62, and move the sheet along the transfer path defined by the path of movement of the chain conveyors, the transfer path being herein generally designated by the arrows P. It should be noted that in conventional printing presses, the drive shaft 76 supporting the sprocket wheels 74 typically also functions to support many of the conventional transfer systems such as skeleton wheels, transfer cylinders, and the like. As will become more apparent hereinafter, the vacuum transfer apparatus 10 of the present invention can be positioned within the press with or without removing the conventional transfer apparatus then existing in the press.

In mounting the vacuum transfer apparatus 10 to the press, it is important to attempt to position the upper end of the manifold housing 16 as close to the impression cylinder 62 as practically possible to insure a smooth transfer of sheets S from the impression cylinder to the support bars 46. While different types of mountings may be required for different types of printing presses, herein the vacuum transfer apparatus 10 of the exemplary embodiment is illustrated mounted in a Heidelberg 102 Speedmaster press. As shown, the manifold housing 16 is mounted to the press adjacent its upper end by a pair of mounting brackets 80 coupled to the press frame, and at its lower end by the laterally spaced stanchions 32 supported by the floor on which the press stands.

In the various embodiments disclosed herein, each support bar 46 preferably is made of tubular or solid aluminum stock for example type 6061TG. The diameter of the support bars is preferably one inch. Each support bar is rigidly mounted to the side panels 16A, 16B of the manifold housing 16 by screw fasteners removably secured to the side panels 16A, 16B.

Figure 8:
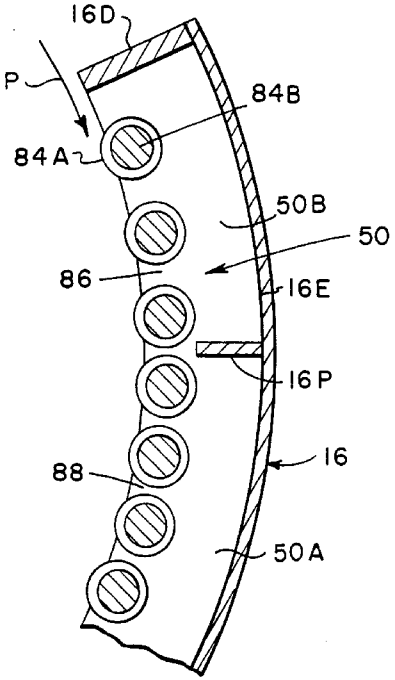
FIG. 8 is a sectional view thereof taken along the line 8—8 of FIG. 7.
Figure 7:
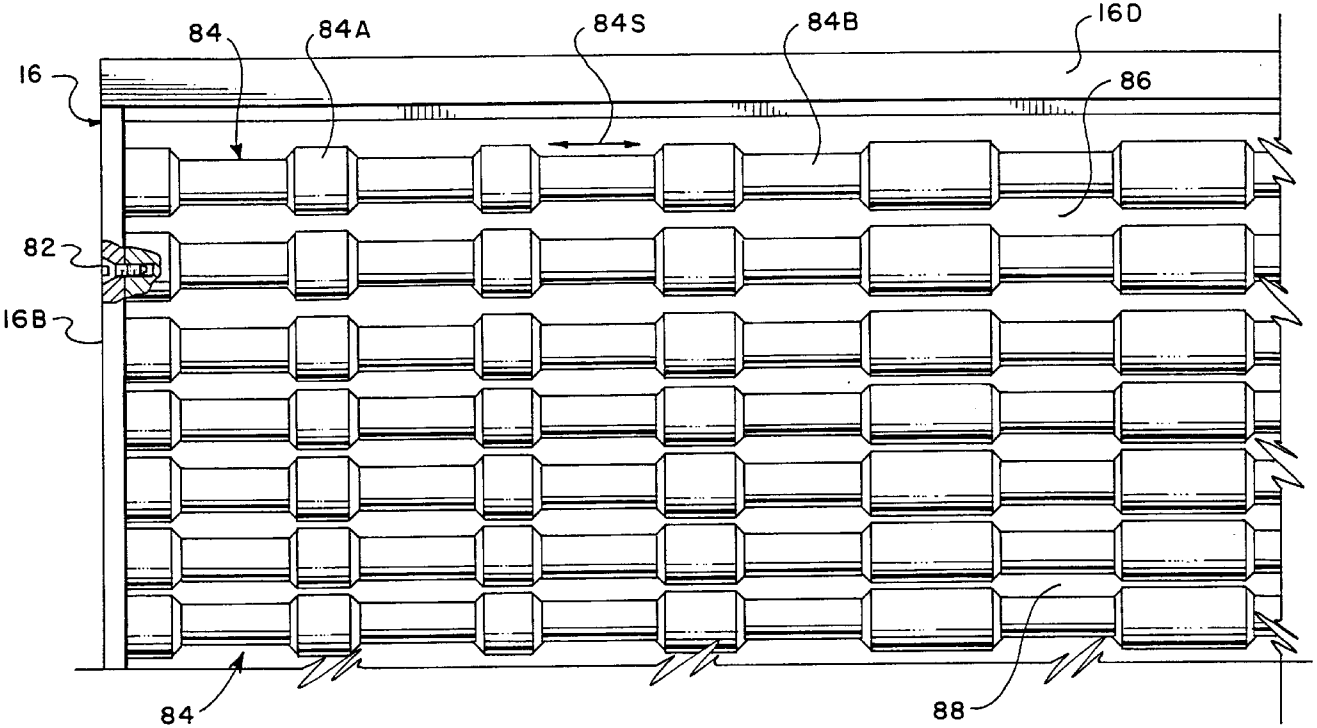
FIG. 7 is a top plan view, partially broken away, of an alternative embodiment in which guide support bars are contoured to provide arcuate slots to provide rotational clearance for grippers.
Figure 9:
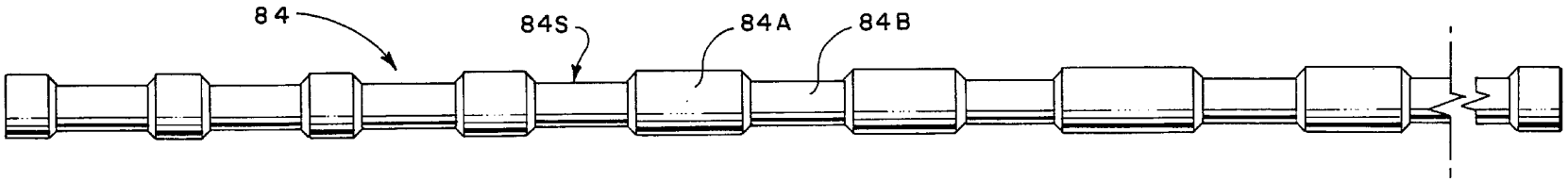
FIG. 9 is a side elevational view of one of the contoured guide support bars shown in FIG. 7.

According to another embodiment of the invention as shown in FIGS. 7, 8 and 9, a group of contoured support bars 84 are rigidly mounted along the top section 44B of the concave airflow inlet opening 44. As can be seen in FIG. 7, the contoured support bars 84 have alternating large diameter segments 84A separated by annular recesses 84S and small diameter segments 84B. The contoured support bars 84 are relatively widely spaced in the upper section thereby defining inlet apertures 86 which have a relatively large cross sectional flow area as compared to the longitudinal flow apertures 88 between the relatively closely spaced support bars 84 in the lower section. Additionally, the annular recesses 84S between the large diameter segments 84A are spaced to permit passage of the grippers 78A.

The relatively larger airflow apertures 86 in the upper suction zone 50B establish a differential airflow gradient along the curved transport path P, so that a strong suction force will be applied to the leading edge portion of the sheet material as it is pulled through a reverse curvilinear path P. It should be understood that the printed sheet is otherwise unsupported after it is gripped and pulled from the impression cylinder. Accordingly, a strong suction force is initially required to pull the unsupported sheet material against the support bars 84, and relatively less suction force is required as the sheet material is subsequently conveyed along the relatively closely spaced support bars 84 in the lower chamber section 50A of the curved transfer path P.

The slot recesses 84S permits the support bars 84 to be located closer to the transfer path P since the annular recesses provide radial clearance for the grippers 78A of the transfer conveyor 6B to pass below the support surface of the guide support bars. Typically, the grippers 78A of a transfer conveyor project approximately ⅛ inch beyond the gripper bar assembly 78 in the direction radially outwardly with respect to the axis of the drive shaft 76 of the sprocket wheels 74. By locating the recesses 84S along the support bars 84 to coincide with the locations of the grippers 78A, the grippers can pass freely through the recesses. Accordingly, the support surfaces 84A of the support bars 84 can be positioned to be substantially tangent to the true transfer path P, thereby providing a smooth and uniform transition for the sheet S as it initially engages the vacuum transfer apparatus 10.

In the exemplary embodiments, the slot recesses 84S are each approximately 1-9/16 inch wide, but are not uniformly spaced along the support bars 84. Rather, the locations of the recesses 84S have been selected to coincide with the locations of the grippers 78A found on the transfer conveyor 68 of the Heidelberg 102 Speedmaster press. In that particular type of press, the grippers 78A are spaced more closely together along the gripper bars from the mid point laterally outwardly toward the ends at the chains 72 so that the recesses 84S must be similarly spaced to permit the grippers 78A to travel past the guide support bars 84.

While the foregoing specific dimensions have been set forth for the exemplary embodiments shown in the drawings, it should be appreciated that other types of presses may require that the spacing and width of the recesses 84S be altered to suit the particular press. It is important to note that in selecting the particular spacing and width of the recesses 84S, the effective air inlet area into the vacuum chamber upper portion 50B should be made to have approximately twice or more effective area as that of the vacuum chamber lower portion 50A so that the airflow volume per unit area through the upper portion is approximately twice or more than that of the airflow volume unit area through the lower portion. This will insure that the sheet S will be smoothly and uniformly drawn rapidly onto the vacuum transfer apparatus 10 as it is initially pulled from the impression cylinder 62 so that the printed side of the sheet can not contact any other apparatus in the press.

Moreover, while the exemplary embodiments have been represented in the context of a press having a transfer conveyor 68 employing chains 72 and gripper bars, the vacuum transfer apparatus 10 can equally be used with presses having other types of transfer conveyors since the vacuum transfer apparatus 10 of the invention will prevent the wet inked side of a sheet S from coming into contact with other press apparatus such as transfer wheels and cylinders. Thus, when used for example in a perfecting type press, the vacuum transfer apparatus 10 can be installed to supplement the existing transfer system without requiring removal of the existing transfer system. In such a case, the vacuum transfer apparatus 10 can be used whenever one sided sheet printing is to be done, and then deactivated when the press is used in the perfector mode for two sided sheet printing.

Figure 4:
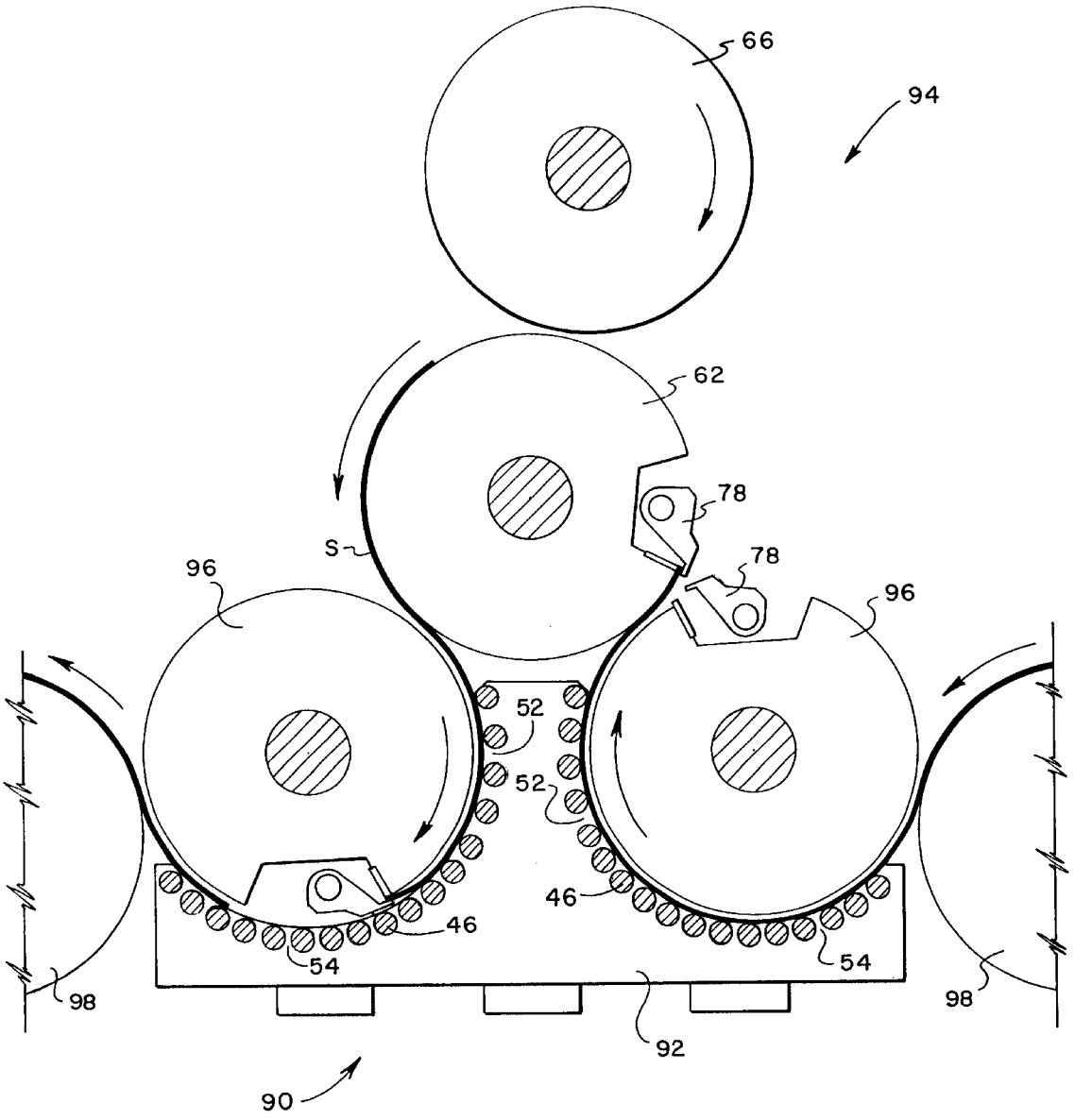
FIG. 4 is a side elevational view which illustrates the sheet transfer assembly of the present invention as installed in a multi-station printing press.
Figure 6:
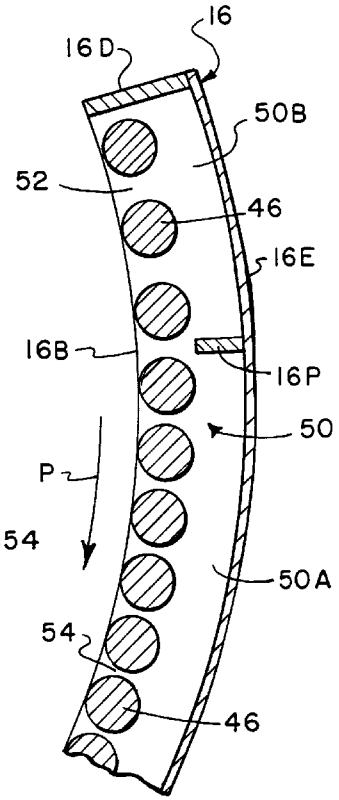
FIG. 6 is a sectional view thereof taken along the line 6—6 of FIG. 5.
Figure 5:
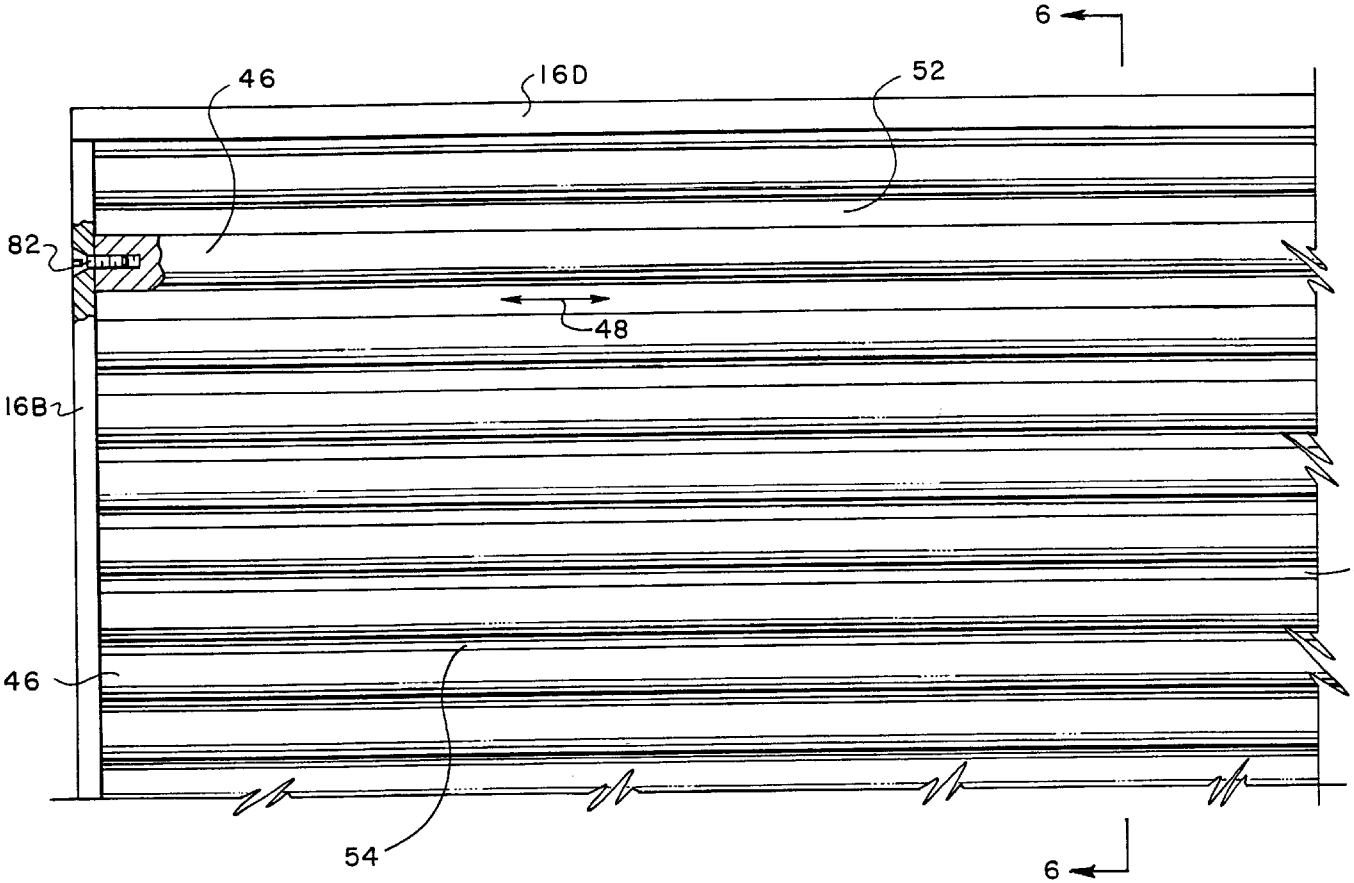
FIG. 5 is a top plan view, partially broken away and partially in section, of the sheet transfer support assembly shown in FIG. 1.

Referring now to FIG. 4, a dual sheet transfer assembly 90 is installed on a common manifold housing 92 between two stations of a multi-unit rotary printing press 94. The printing press 94 may include as many as seven or more printing stations for printing a corresponding number of color impressions upon sheets fed therethrough. The first station shown in FIG. 4 receives a sheet S as it is transferred from a dry transfer cylinder 98. The next station as shown in FIG. 4 is adapted to print a second color impression in superimposed relation on the same printed face of the sheet S, and for this purpose includes an impression cylinder 62 and a blanket cylinder 66. The sheet S is gripped and pulled along the transfer path by grippers 78 mounted on each transfer cylinder. Conventional skeleton wheels or other intermediate cylinder surfaces are not required for support purposes since the sheet S is supported entirely on the support bars 46 of the support bar assembly 12.

According to this arrangement, the dry, unprinted side of each sheet S is supported by the support bar assembly 12 as it is delivered from a conventional transfer cylinder 96 to the impression cylinder 62. That is, the wet, printed side of each sheet S is not engaged or contacted as it moves along the transfer path P. The sheet S is carried on the impression cylinder 62 to receive an impression from the blanket cylinder 66. After receiving the impression, the sheet S is conveyed on another support bar assembly 12 to a dry transfer cylinder 98 to another printing station, if it is to receive another color impression, or it may be transferred to a delivery sheet conveyor 68 and carried to a delivery stack 70 as shown in FIG. 3.

The embodiments shown in FIGS. 1–9 utilize multiple guide support bars which are closely spaced along the curved sheet transfer path P. Frictional engagement between the sheet material and the external surfaces of the guide support bars is further minimized by providing the guide bar surfaces with a coating of material having a low coefficient of friction, for example Teflon.

Figure 11:
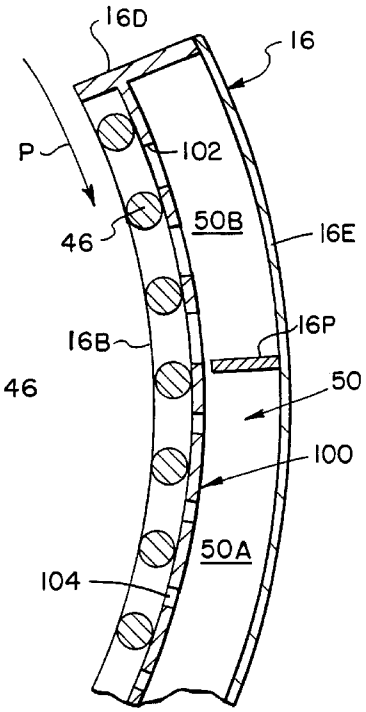
FIG. 11 is a side elevational view thereof, taken along the line 11—11 of FIG. 10.
Figure 10:
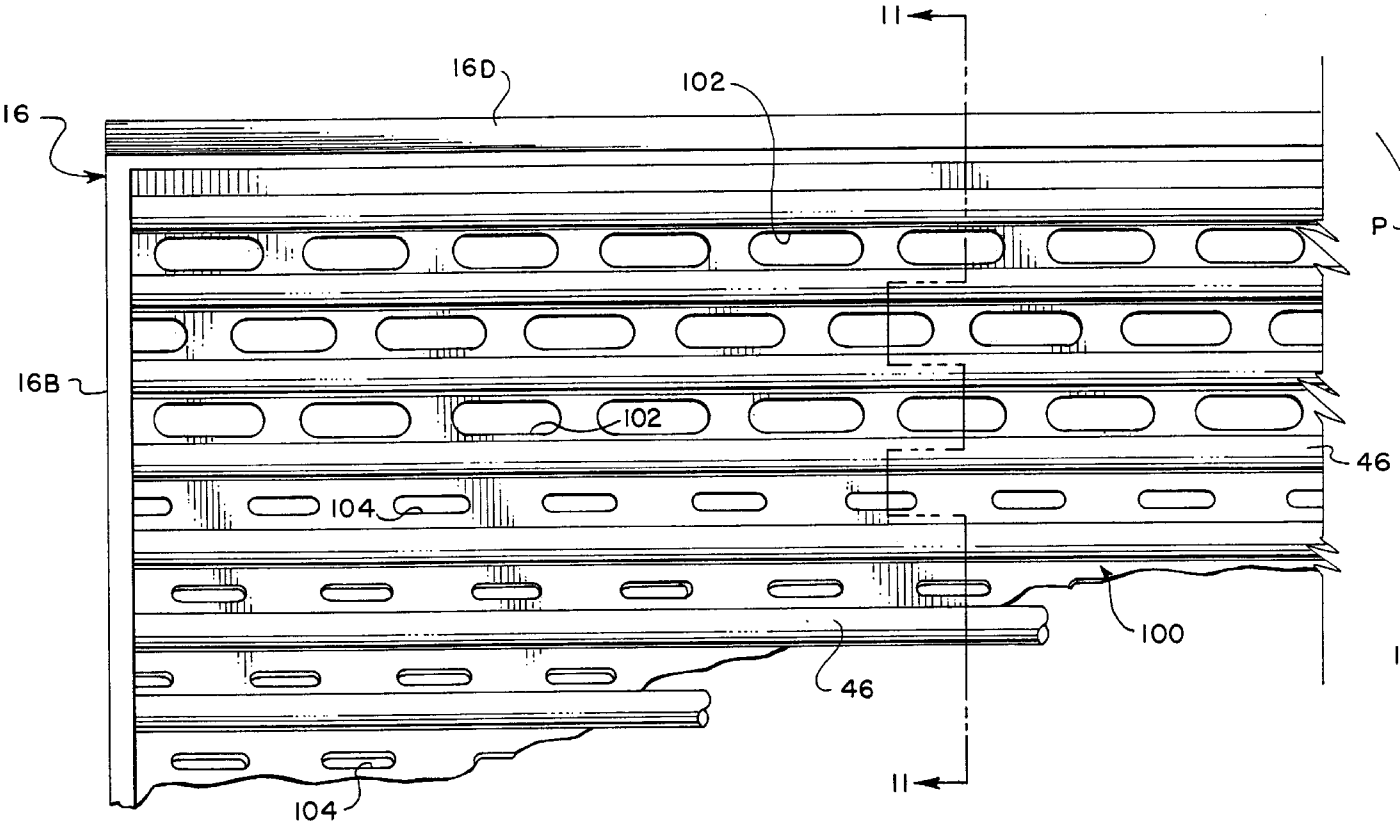
FIG. 10 is a top plan view, partially broken away, of an alternative embodiment of the present invention in which a perforated back plate is combined with the guide support bars for producing differential airflow gradients.

According to another embodiment of the present invention, frictional engagement and drag between the sheet and support components is minimized by reducing the number of guide support bars as shown in FIG. 10 and FIG. 11. In this embodiment, the guide support bars 46 are relatively widely spaced apart along the curved transfer path P. Differential airflow is provided by a perforated back plate 100. The perforated back plate 100 is a semi-cylindrical section which is substantially concentric with and radially spaced outwardly with respect to the curved transfer path P. The curved back plate 100 is mounted on the frame and is interposed between the guide support bars 46 and the vacuum chamber 50. The back plate 100 is intersected by plurality of large apertures 102 and by a plurality of relatively smaller apertures 104.

Preferably, the airflow apertures 102 which overlie the upper vacuum chamber 50B have a total effective airflow passage area, which is relatively greater than the total effective airflow passage area provided by the relatively smaller apertures which intersect the lower section of the back plate which overlies the lower vacuum chamber 50A. The support bars 46 are substantially equally spaced along the transfer path, with the airflow apertures 102, 104 being substantially centered between adjacent support bars. While the airflow apertures 102, 104 which intersect the back plate 100 can have any configuration, they are preferably in the form of elongated slots, with the longitudinal axis of each slot extending generally parallel with the longitudinal axis of the support bars.

Figure 12:
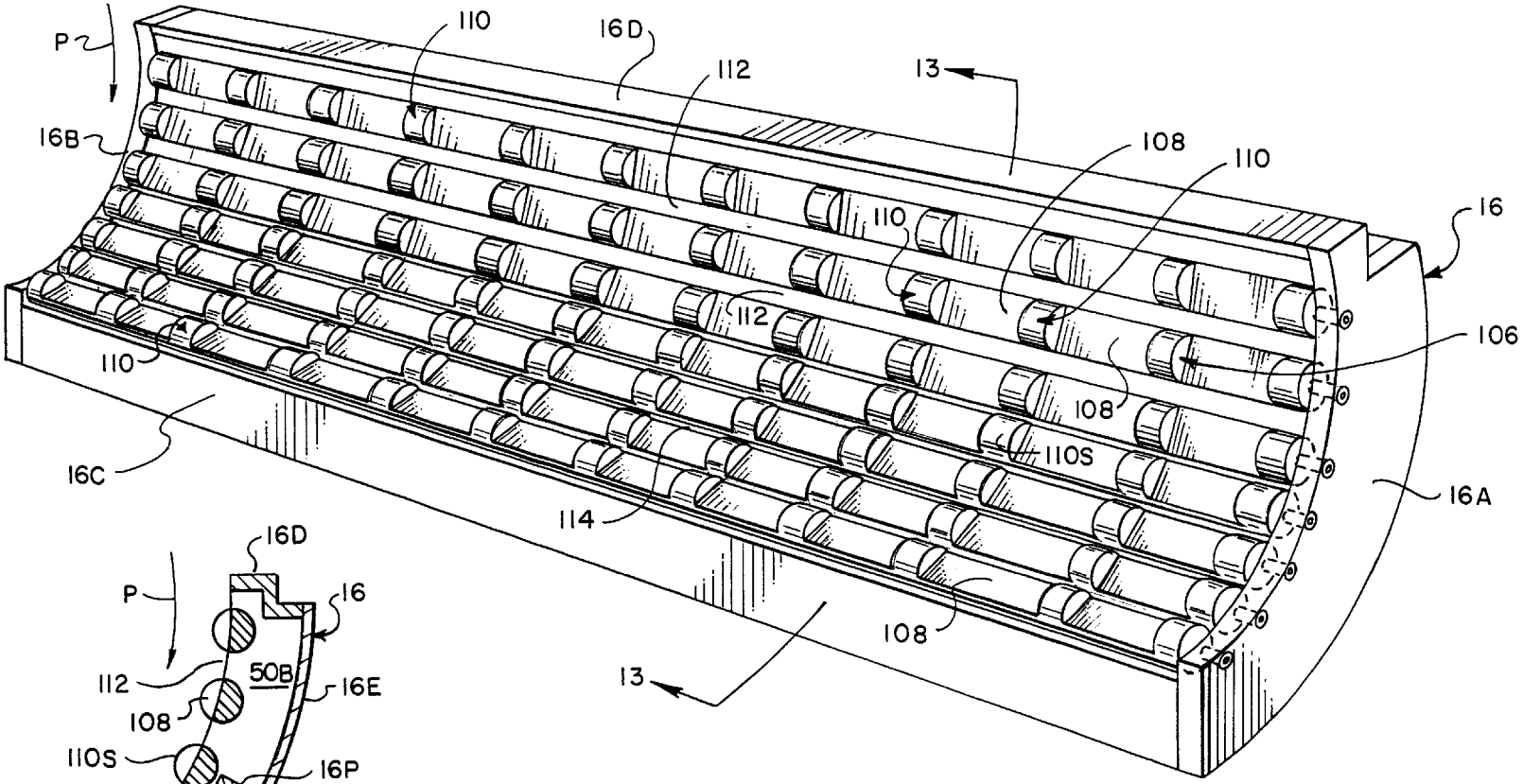
FIG. 12 is a perspective view of an alternative embodiment of the invention, in which elongated guide support bars are contoured and intersected by slots which are aligned circumferentially to provide rotational clearance for gripper bars.
Figure 13:
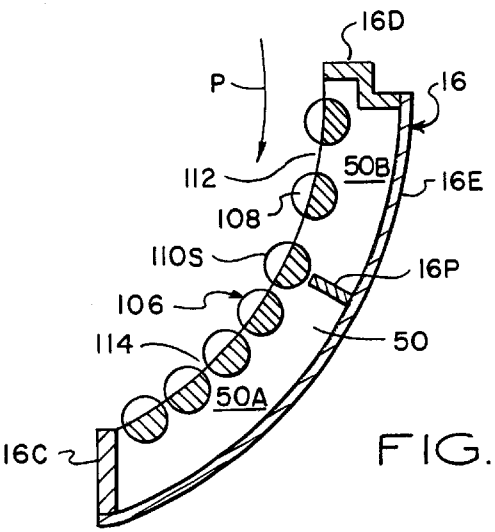
FIG. 13 is a sectional view thereof taken along the line 13—13 of FIG. 12.

Referring now to FIG. 12 and FIG. 13, yet another alternative embodiment is illustrated which utilizes minimum surface contact components for guiding and supporting the unprinted surface of a professionally printed sheet. In this embodiment, the sheet material is guided and is supported closely to the vacuum transfer apparatus, thereby reducing suction airflow requirements. This is achieved by an array of guide support bars 106, each of which have a plurality of semi-cylindrical slots 108, with the semi-cylindrical slots being separated by support bar segments 110. The support bar segments each have a curved sheet engagable surface 110 which is tangentially aligned with the true sheet transfer path P. Moreover, the semi-cylindrical slots 108 of adjacent support bars 106 are aligned with each other to permit rotary passage of grippers. The guide support bars 106 which overlie the upper vacuum chamber 50B are relatively widely spaced, thereby defining elongated airflow apertures 112. The guide support bars 106 which overlie the lower vacuum chamber 50A are relatively closely spaced, thereby defining elongated airflow inlet apertures 114.

According to this arrangement, a differential airflow gradient is produced along the transfer path P by the relatively greater volume of air which is drawn through the widely spaced airflow inlet apertures 112 relative to the volume of air drawn through the relatively smaller airflow inlet apertures 114. The differential airflow gradient is increased by partitioning the lower support bar manifold chamber 50A with respect to the upper manifold chamber 50B. A partition panel 16P extends longitudinal across the length of the manifold housing 16, thereby separating the two chambers 50A, 50B. As previously described, the lower manifold chamber 50A has a single suction port 56 coupled to the suction air duct 22, which is isolated with respect to the upper manifold chamber 50B. The upper manifold chamber 50B has outlet ports 58, 60 which are coupled to the suction air manifold 28 by the suction air ducts 18, 20, respectively. According to this arrangement, airflow through the large apertures 112 is substantially increased relative to the airflow through the smaller apertures 114 and the lower chamber section. The area of surface engagement between a sheet being conveyed through the sheet transfer apparatus is minimized because the sheet is contacted only by the curved surfaces 110S of the support bar segments 110.

Figure 14:
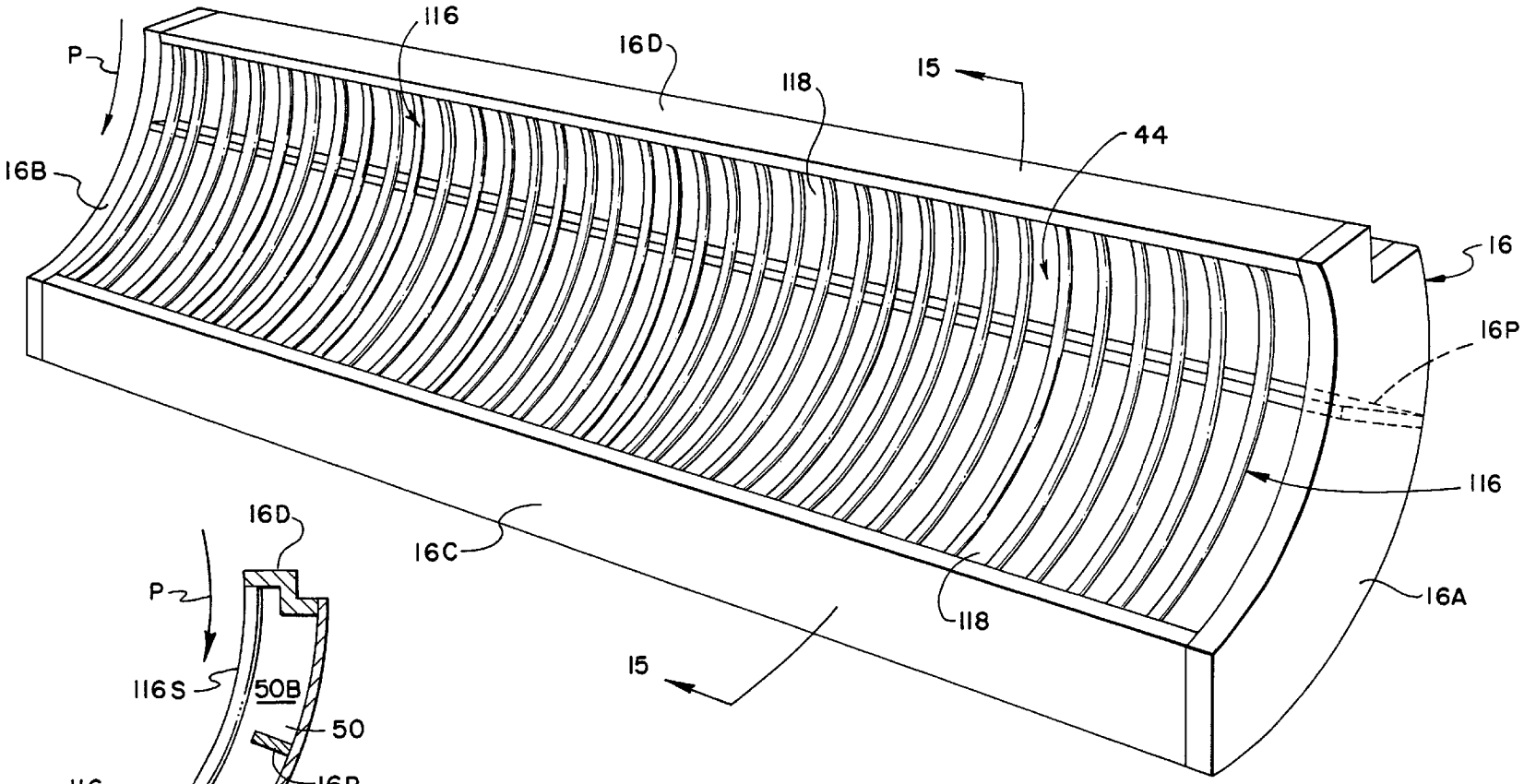
FIG. 14 is a perspective view of an alternative embodiment in which sheet transfer support is provided by a concave array of curved support bars which are laterally spaced with respect to each other and which extend circumferentially in curved alignment with an arcuate sheet transfer path.
Figure 15:
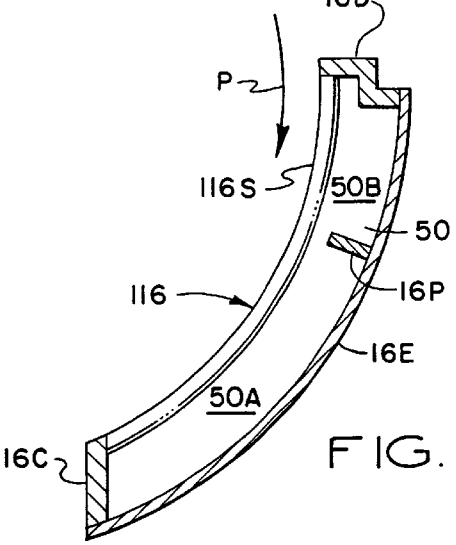
FIG. 15 is a side elevational view thereof taken along the line 15—15 of FIG. 14.

Referring now to FIG. 14 and FIG. 15, an array of curved support bars 116 are mounted over the airflow inlet 44. The support bars 116 are curved and have a sheet engaging surface 116 which is substantially concentric with the curved sheet transfer path P. The curved support bars 116 are laterally spaced apart in side-by-side relation, thereby defining a plurality of laterally spaced, circumferentially extending inlet apertures 118. The sheet engaging surface 116S of each support bar provides a smooth surface for supporting and guiding sheet material along the transfer path P while constraining the flow of inlet air through the elongated inlet apertures 118. Differential airflow is provided by the partition panel 16P, together with the air ducts 18, 20 which are coupled to the upper vacuum chamber 50B and by the air duct 22 which is coupled to the lower vacuum chamber 50A. According to this arrangement, a relatively greater airflow per unit area through the upper manifold chamber 508 is produced relative to the airflow per unit area through the lower manifold chamber 50A.

Figure 16:
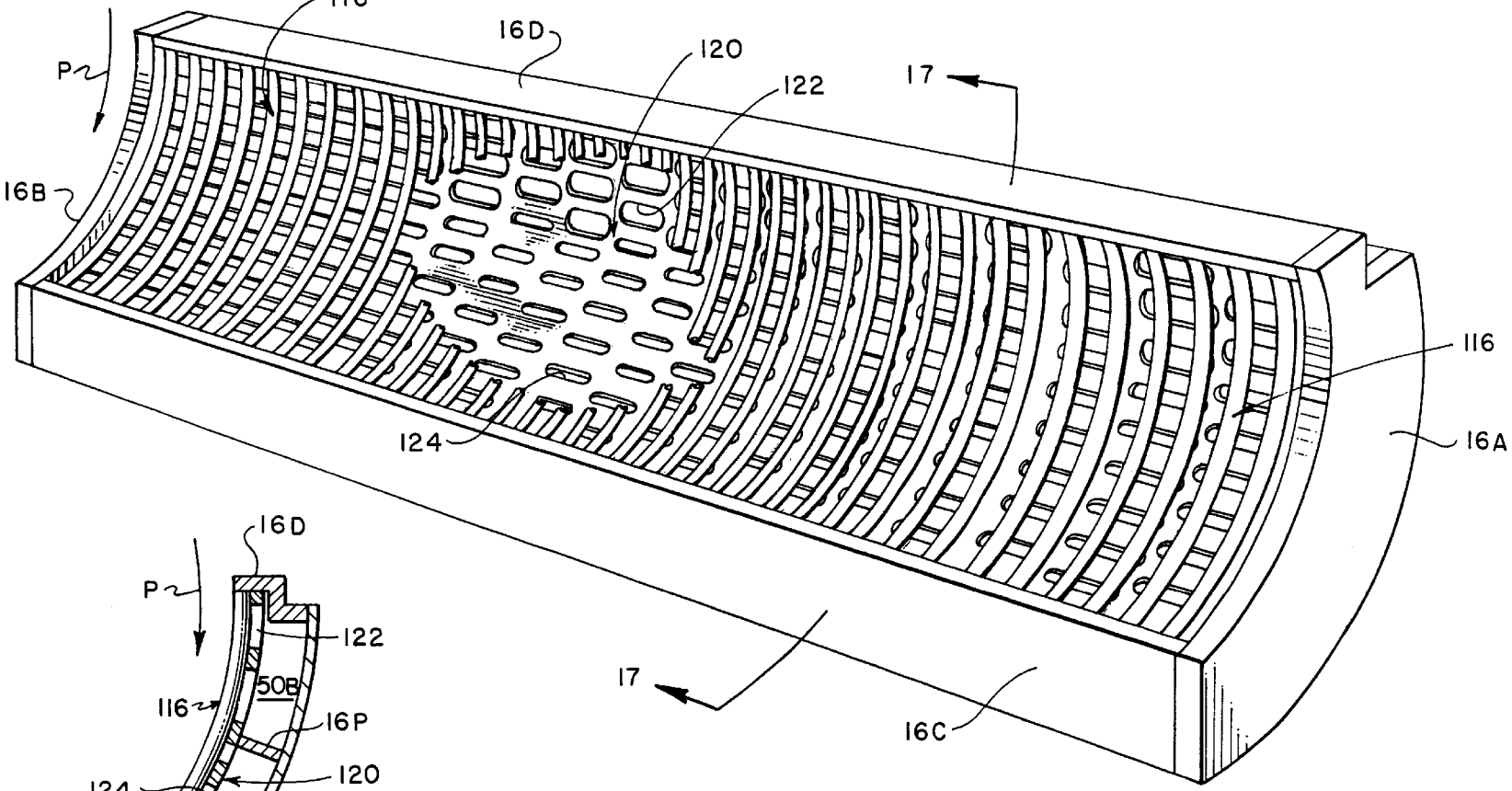
FIG. 16 is a perspective view of an alternative embodiment of the present invention in which a curved, perforated back plate is combined with the curved support bars as shown in FIG. 14 for producing differential airflow gradients along an arcuate sheet transfer path.
Figure 17:
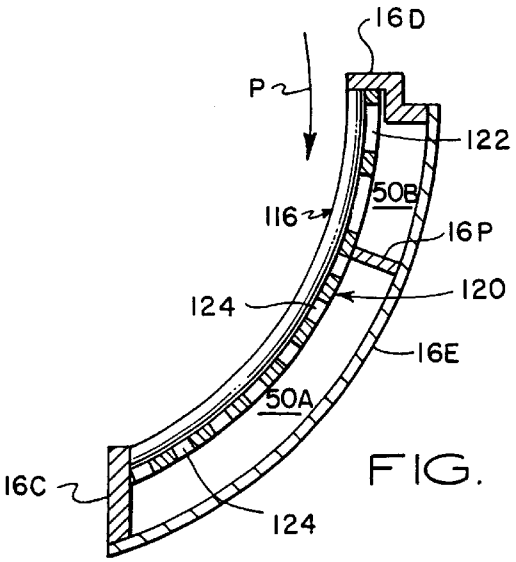
FIG. 17 is a sectional view thereof, taken along the line 17—17 of FIG. 16.

Referring now to FIG. 16 and FIG. 17, the airflow gradient is provided by a perforated back plate 120 which underlies the curved support bars 116. The curved back plate 120 is intersected by large area apertures 122 and small diameter apertures 124. The large area apertures 122 provide flow communication with the upper vacuum chamber 50*b* while the small area apertures 124 provide airflow communication with the lower vacuum chamber 50A, thereby producing a differential airflow gradient along the transfer path P.

Figure 18:
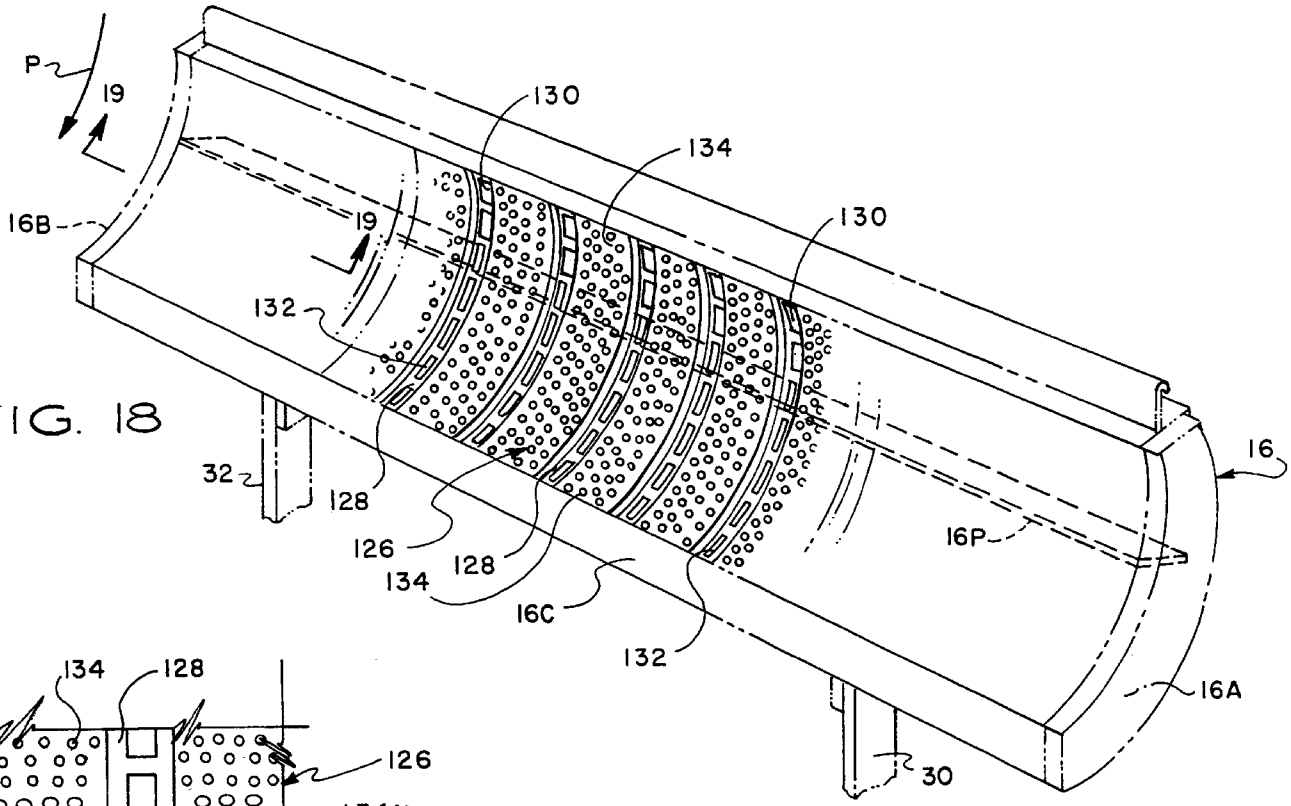
FIG. 18 is a perspective view of an alternative embodiment of the present invention, which features a sheet transfer plate having small surface nodes which are separated by gripper bar slot indentations.
Figure 19:
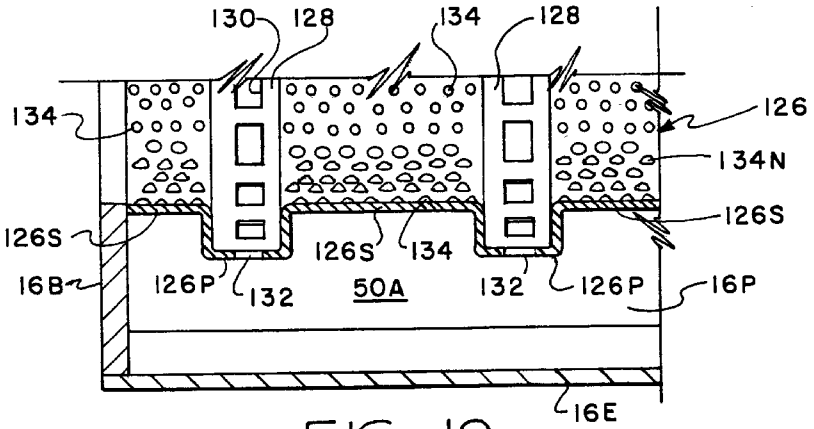
FIG. 19 is a sectional view thereof, taken along the line 19—19 of FIG. 18.

Referring now to FIG. 18 and FIG. 19, yet another alternative embodiment includes a curved sheet transfer plate 126 which is mounted on the manifold housing 16 and overlies the airflow inlet opening 44. The curved sheet transfer plate 126 has a plurality sheet support sections 126S laterally spaced apart and a plurality sheet support sections 126S laterally spaced apart and disposed substantially in concentric relation with the curved transfer path P. The sheet support sections 126S are laterally separated by radially offset transfer plate sections 126P. The transfer plate sections are radially offset into the vacuum chamber 50, thereby defining a plurality of annular slots 128. The transfer plate sections 126P are intersected by a plurality of airflow apertures 130, 132. The apertures 130 which overlie the upper vacuum chamber 50B are relatively large in area as compared to the airflow area of the smaller apertures 132 which overlie the lower vacuum chamber 50A. According to this arrangement, the airflow apertures 130 in the radially offset transfer plate sections overlying the upper chamber region 50B have a total effective airflow passage area which is relatively greater than the total effective airflow passage area provided by the airflow apertures 132 in the transfer plate sections overlying the lower vacuum chamber region 50A. Preferably, the apertures are elongated slots and extend circumferentially along the transfer plate sections 126P.

According to an important feature of this embodiment, the sheet transfer plate 126 includes radially projecting nodes 134. Each node has a sheet engagable surface which is concentrically positioned in tangential alignment with the true curved transfer path P. According to this arrangement, the sheet materials engaged only by the nodes 134 as it transits along the curved transfer path P. Moreover, the annular slots 128 provide radial clearance for grippers 78A as the sheet is pulled along the curved transfer path P.

Figures 20, 21, 22:
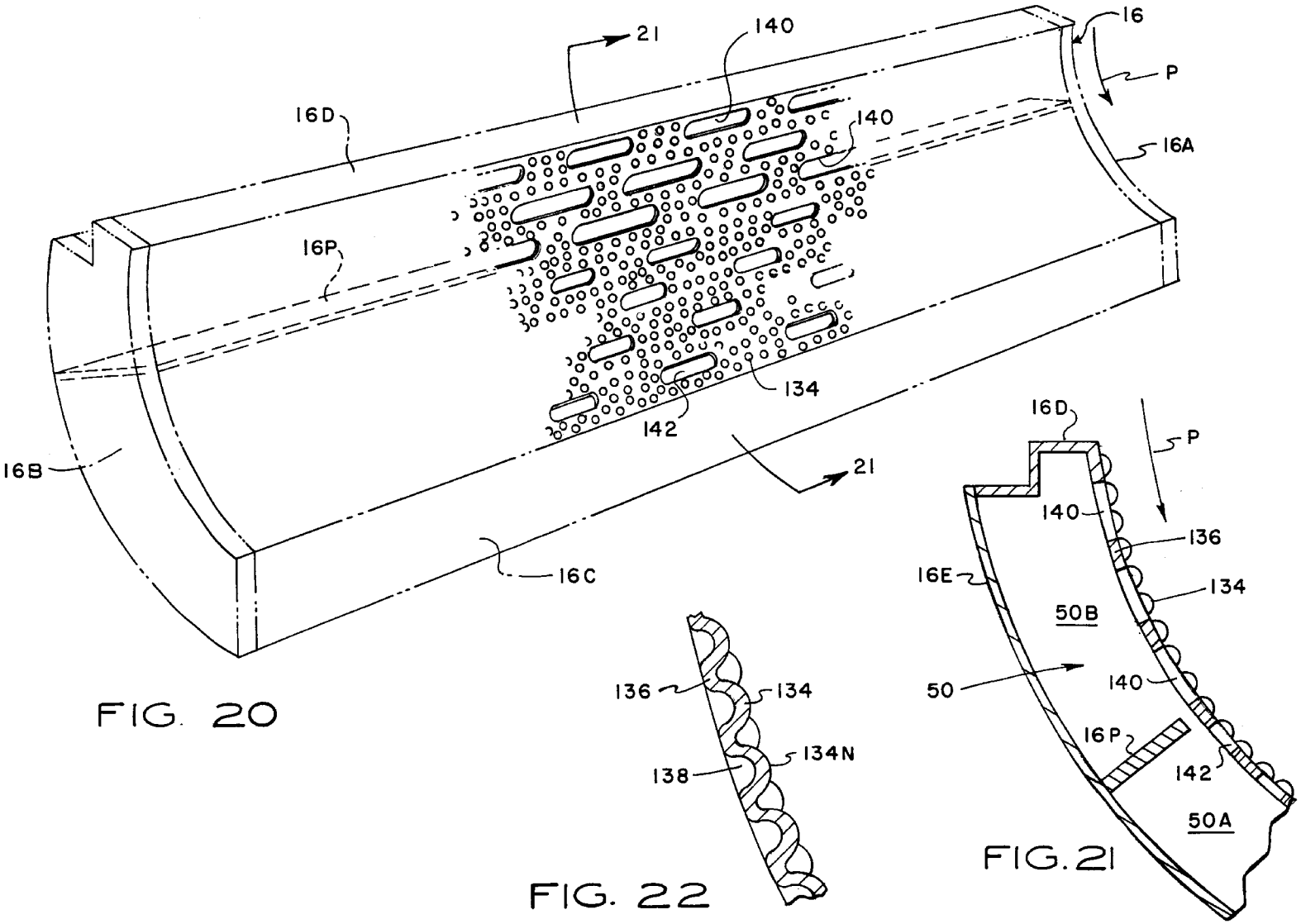
FIG. 20 is a perspective view of an alternative embodiment of the present invention having a semi-cylindrical sheet transfer plate which is perforated to produce differential airflow gradients along an arcuate transfer path, and which includes surface nodes projecting therefrom for minimizing the area of frictional engagement.
FIG. 21 is a side elevational view thereof, partially broken away, taken along the line 21—21 of FIG. 20.
FIG. 22 is an enlarged sectional view, partially broken away, of a portion of the semi-cylindrical back plate shown in FIG. 20.

Referring now to FIGS. 20, 21 and 22, sheet guidance and support is provided by a curved transfer plate 136 which is mounted onto the manifold housing 16 in substantially concentric alignment with the curved transfer path P. In this embodiment, the curved transfer plate has nodes 134 formed on the sheet engaging side of the plate, and dimples 138 formed on the underside of the transfer plate. Moreover, the curved transfer plate 136 is intersected by large area apertures 140 which overlie the upper vacuum chamber 50B and relatively small area apertures 142 which overlie the lower vacuum chamber 50A. The differential airflow radiant is enhanced by the partition plate 16P.

Figure 23:
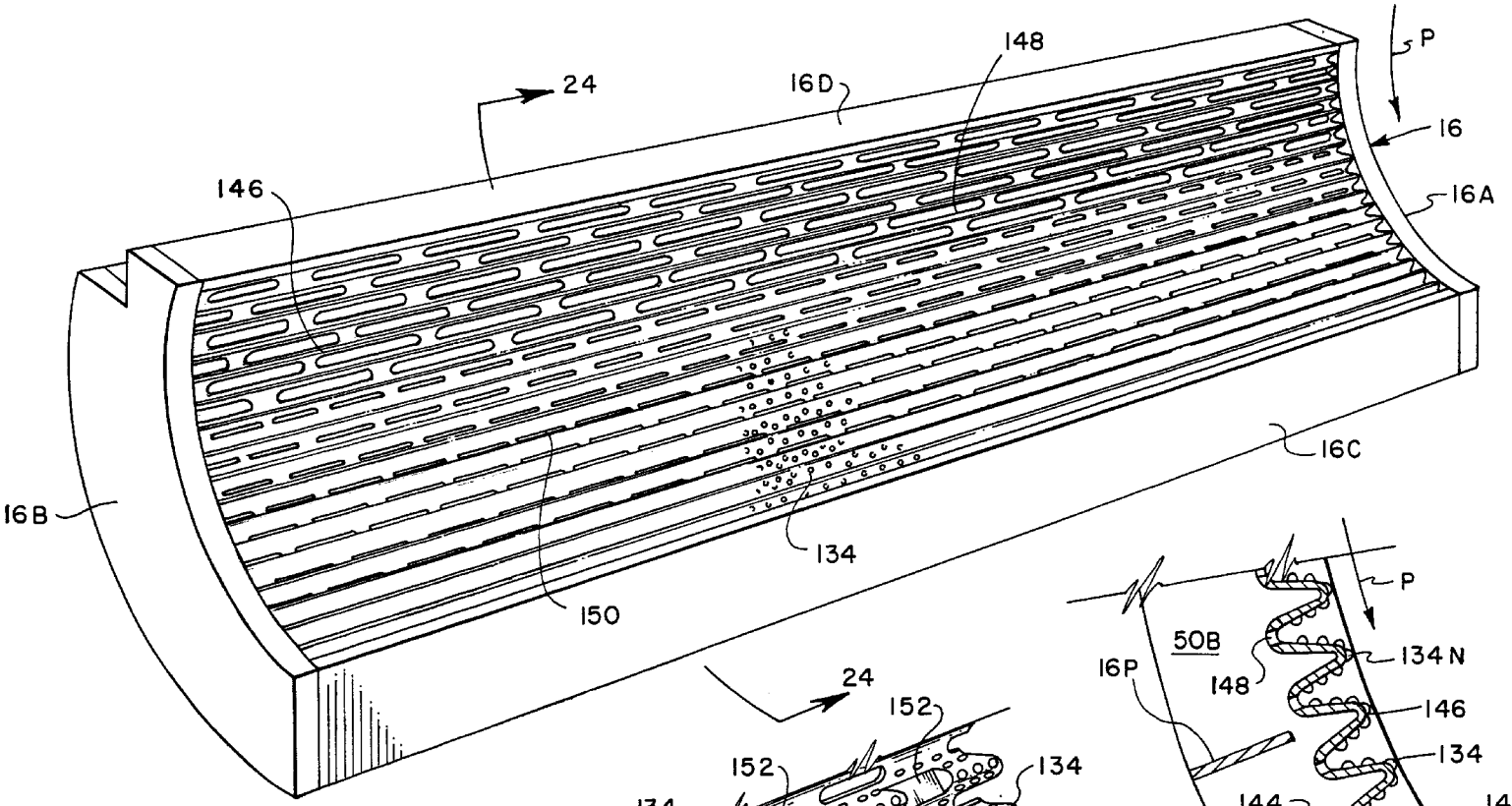
FIG. 23 is a perspective view of another alternative embodiment of the present invention, in which sheet support is provided by a perforated back plate generally in the form of a semi-cylindrical section, having undulating rib portions and external surface nodes.
Figure 24:
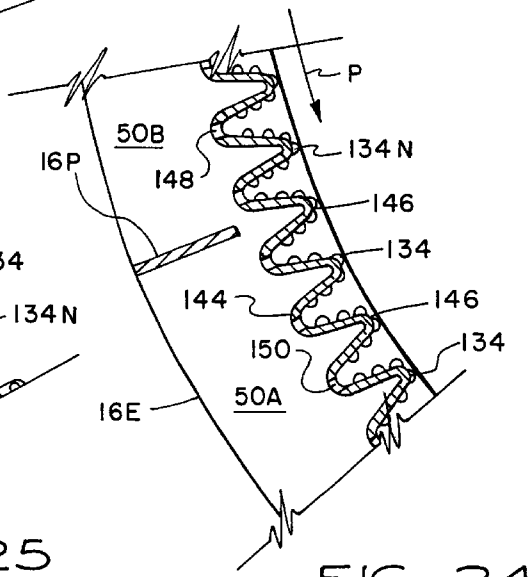
FIG. 24 is a sectional view thereof, taken along the line 24—24 in FIG. 23.
Figure 25:
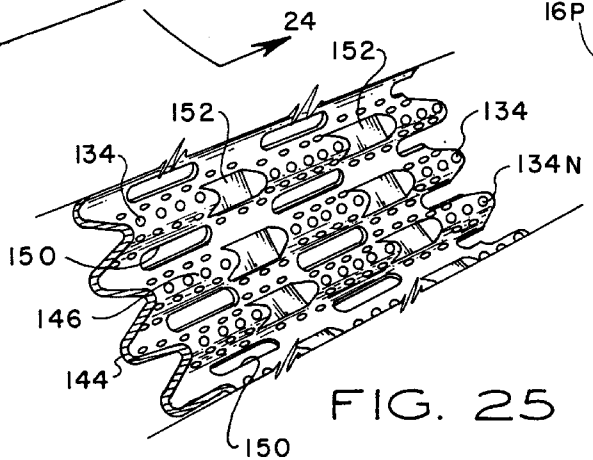
FIG. 25 is a perspective view, partially broken away, of an alternative embodiment in which gripper bar slots are formed in the longitudinal rib portions of the sheet transfer plate of FIG. 23.

Referring now to FIGS. 23, 24 and 25, another embodiment is illustrated in which the airflow ended opening 14 is covered by a semi-cylindrical, undulating transfer plate 144. In this embodiment, the transfer plate has undulating rib portions 146 which extend transversely with respect to the sheet transfer path P. The ribs 146 are circumferentially spaced with respect to each other and are positioned substantially in circumferential alignment in concentric relation with the sheet transfer path P. The transfer plate has trough portions 144 which are intersected by large diameter slots 148 and small diameter slots 150.

According to one alternative embodiment, the undulations 146 are intersected by a plurality of circumferentially annular slots 152 as shown in FIG. 25, thereby permitting rotary passage of gripping means as previously described.

The large area airflow apertures 148 in the transfer plate section overlying the upper vacuum chamber region SOB have a total effective airflow passage area which is relatively greater than the total effective airflow passage area provided by the airflow apertures 150 in the transfer plate section overlying the lower vacuum chamber 50A.

Preferably, the surface of the undulating rib portions 146 is provided with radially projecting nodes 134. The radially projecting nodes 134 have sheet engagable surfaces which are positioned substantially in concentric alignment with an intangential relation to the true sheet transfer path P, as shown in FIG. 24. According to this arrangement, the area of surface engagement with the sheet is minimized, thereby reducing frictional engagement and drag as the sheet is pulled along the sheet transfer path P.

Figure 26:
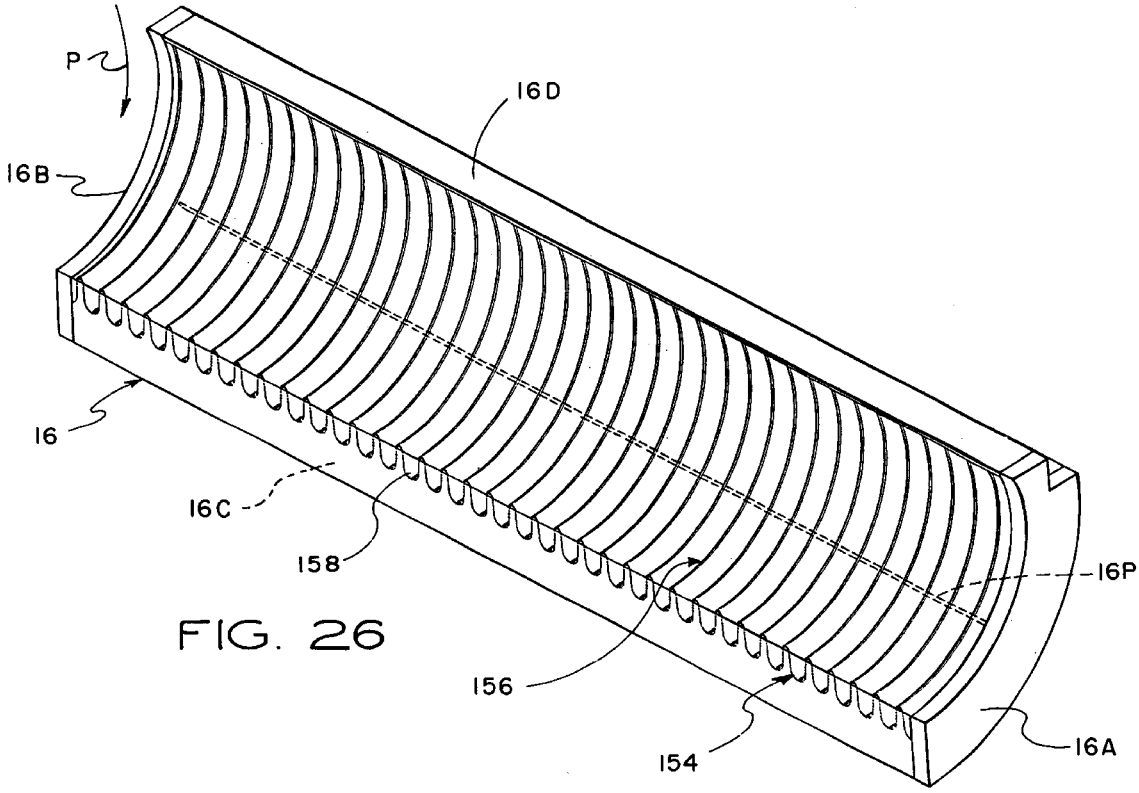
FIG. 26 is a perspective view of yet another alternative embodiment, in which sheet transfer support is provided by a semi-cylindrical plate having laterally spaced undulations which provide circumferentially extending rib portions; and, FIG. 27 is a developed plan view of a portion of the sheet transfer plate assembly shown in FIG. 26, with the transfer plate having perforations between adjacent ribs for producing differential airflow gradients along a curved sheet transfer path.
Figure 27:
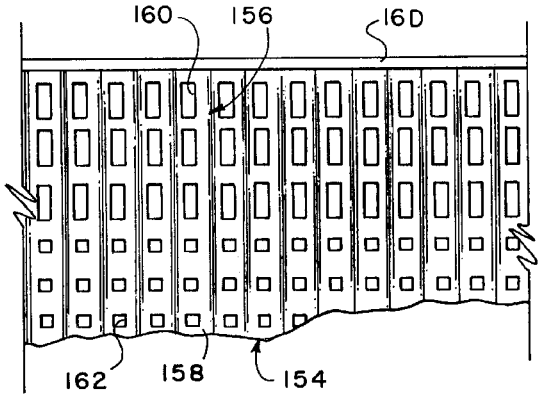

Referring now to FIGS. 26 and 27, yet another alternative embodiment is illustrated. In this alternative housing 16 and overlies the airflow inlet opening 44. The sheet transfer plate 154 has undulating rib portions 156 which are laterally spaced apart in side-by-side relation and extend substantially in circumferentially alignment with the sheet transfer path P. The transfer plate 154 has trough portions 158 which are intersected by large area airflow apertures 160 and by relatively smaller airflow apertures 162. Preferably the circumferentially extending rib portions 156 are laterally spaced apart to permit rotary passage of gripping means as previously discussed. Moreover, the airflow apertures 160 overlying the upper vacuum chamber region 50B have a total effective airflow passage area which is relatively greater than the total effective airflow passage area provided by the airflow apertures 162 which overlie the lower vacuum chamber region 50A. According to this arrangement, the ribs 156 provides smooth surfaces for supporting a sheet material as it is pulled along the transfer path P, with the area of surface engagement being minimized to reduce frictional engagement and drag.

It should be understood that the support bars, ribs, nodes and other sheet engaging surfaces of the various embodiments discussed above have a coating of low friction material, such as Teflon, to further reduce frictional drag. It will be appreciated that in each of the various embodiments described above that surface contact engagement between sheet material and the contacting components, whether it be the linear support bars, the curved support bars, the nodes, or the undulating ribs, that surface contact with sheet material is minimized, thereby reducing frictional drag. Moreover, in those embodiments which include gripper bar slots, the sheet material can be positioned closely to the vacuum source, thereby requiring less suction airflow, thereby minimizing leakage and reducing the suction airflow requirements.

A further advantage of the foregoing sheet transfer apparatus is that the conventional transfer components such as skeleton wheels and air cushion cylinders can be completely removed from the press, thereby providing space for auxiliary equipment such as dryers.

From the foregoing description, it will be appreciated that the sheet transfer system 10 positively prevents streaking, smudging or smearing of a printed sheet S after the sheet material has been taken from an impression cylinder. This is made possible by the suction force which pulls the dry, unprinted side of each sheet onto the guide support bars, thereby avoiding contact of the printed surface of the sheet material against a transfer cylinder as it is transferred from one printing station to another. Preventative make-ready work which has been required in connection with conventional skeleton wheels is eliminated. The sheet transfer system 10 may be installed directly adjacent to existing transfer cylinders. In new installations, the conventional skeleton wheel and transfer cylinder shells are eliminated. It will be appreciated that since the sheet S is not contacted or engaged by pointed surfaces of a skeleton wheel, that the sheet transfer system 10 does not alter or impose changes in the dimensions of the sheet and its printing registration. Moreover, marking or smearing of the printed side of the sheet material which has previously been caused by fluttering displacement of the sheet as it transfers through a reverse curvilinear path to the next printing station is avoided since the sheet is stabilized and supported against the guide support bars by the suction force applied through the airflow apertures. Marking or smearing of the printed side of the sheet which has previously been caused by tail slap is prevented, since the trailing edge of each sheet is stabilized and pulled against the support bars of the sheet transfer system 10.

Although the invention has been described in part by making detailed reference to specific alternative embodiments, such detail is intended to be, and will be understood to be, instructional rather than restrictive. It will be appreciated by those skilled in the art that variations may be made in the structure and mode of operation without departing from the spirit and scope of the invention as disclosed herein.

We claim:

1. A sheet transfer apparatus for use in a printing press of the type having an impression cylinder for applying ink to one side of a sheet, a transfer conveyor having means for gripping and transferring the freshly printed sheet from the impression cylinder and conveying the sheet along a transfer path to a further sheet processing station of the printing press, and also comprising a housing member defining a vacuum chamber for mounting adjacent to a predetermined section of the sheet transfer path, means coupled to the housing member for maintaining a partial vacuum within the chamber, and a plurality of elongated support bars coupled to the housing member, characterized in that the housing member has an airflow inlet port in communication with the vacuum chamber; and the elongated support bars overly the airflow inlet port in such a manner that side surfaces of adjacent support bars face each other, thereby forming elongated airflow spaces.

2. A sheet transfer apparatus as set forth in claim 1, characterized by means coupled to the vacuum chamber for producing differential airflow across the support bars in a region overlying a first section of the vacuum chamber relative to the suction airflow across the support bars in a region overlying a second section of the vacuum chamber, the suction airflow volume per unit area into the first chamber section being greater than the suction airflow volume per unit area into the second chamber section.

3. A sheet transfer apparatus as set forth in claim 2, characterized in that the means for producing the differential airflow comprises a greater airflow spacing between the support bars in the region overlying the first chamber section and a smaller airflow spacing between the support bars in the region overlying the second chamber section.

4. A sheet transfer apparatus as set forth in claim 1, characterized in that the elongated support bars are spaced apart in side-by-side relation and extend transversely with respect to the direction of travel of a sheet along the transfer path.

5. A sheet transfer apparatus as set forth in claim 1, characterized in that the elongated support bars having alternating large diameter and small diameter sections, the small diameter sections being spaced apart along each bar to permit rotary passage of gripping means.

6. A sheet transfer apparatus as set forth in claim 1, characterized in that the elongated support bars each having a plurality of slots disposed at longitudinally spaced locations thereon, with adjacent slots being separated by support bar sections each having a sheet engagable surface, the slots of adjacent support bar members being aligned with each other to permit rotary passage of gripping means.

7. A sheet transfer apparatus as defined in claim 1, characterized in that selected support bars are characterized by alternating bar sections which have unequal diameters, thereby defining a plurality of elongated inlet apertures of unequal flow areas extending across the vacuum chamber airflow inlet port.

8. A sheet transfer apparatus as set forth in claim 1, characterized by a back plate mounted on the frame and interposed between the support bars and the vacuum chamber, the back plate being intersected by a plurality of apertures providing airflow communication between the vacuum chamber and the spaces between adjacent ones of the elongated bars.

9. A method of supporting a freshly printed sheet as it is transferred along a sheet transfer path from the impression cylinder of a printing press to a further processing station of the press in which ambient air is drawn across a predetermined section of the sheet transfer path into a vacuum chamber housing member, characterized by the following steps:

restricting the flow of ambient air into the vacuum chamber housing member by constraining the ambient air to flow through elongated airflow spaces defined by an array of support bars which are closely spaced in side-by-side relation over an airflow inlet port of the vacuum chamber housing member; and, transporting the sheet along the sheet transfer path with the unprinted side of the freshly printed sheet being supported by the support bars as the sheet moves across the predetermined transfer path section.

10. A method as set forth in claim 9, characterized by the step of imposing a greater pressure differential across the sheet during movement of the sheet over a first group of support bars than the pressure differential imposed across the sheet during movement of the sheet over a second group of support bars.

11. A sheet transfer apparatus for use with a sheet fed printing press, said apparatus being adapted to be positioned below a sheet delivery conveyor which extends along a sheet travel path from said press to means for receiving freshly printed sheets from said press, said apparatus comprising:

a frame including means defining an air manifold chamber;

a plurality of sheet support members for supporting sheets being transferred along the sheet travel path, said sheet support members extending transversely of the sheet travel path and being spaced apart one from the other along the sheet travel path to provide spaces therebetween in communication with said manifold chamber; and, airflow means coupled in communication with said chamber for drawing air through the spaces between the support members as the sheets are transferred along the sheet travel path.

12. The apparatus set forth in claim 11 wherein:

said airflow means comprises a vacuum pump coupled to a vacuum chamber.

13. The apparatus set forth in claim 11 wherein:

said support members comprise a plurality of elongated bars mounted on said frame for supporting a freshly printed sheet being transferred along said travel path.

14. A sheet transfer apparatus for use in a sheet-fed printing press, said apparatus being adapted to be positioned below a sheet conveyor system for said press along a sheet travel path between a printing unit of said press and means for receiving freshly printed sheets from said press, said apparatus comprising:

a frame including means forming a vacuum chamber;

a plurality of elongated support members supported on said frame and forming a supporting part of said travel path, said support members being adapted to support sheets being transferred by said conveyor system along said travel path, said support members being spaced from each other to provide openings therebetween for admitting air into said chamber to establish a differential pressure across freshly printed sheets being transferred along said travel path.

15. Sheet support apparatus for guiding freshly printed sheets as they are transported by a delivery conveyor along a sheet travel path between a printing unit of a printing press and means for receiving printed sheets from the printing unit, said apparatus comprising:

a frame comprising opposed sidewalls, end walls and a bottom wall forming a vacuum chamber, said frame being supported on said conveyor system in proximity to sheet travel path for sheets being transferred from said printing unit to said means for receiving printed sheets;

a vacuum source coupled to said vacuum chamber; and a plurality of elongated support members mounted on said frame for supporting sheets being transferred by said conveyor system, said support members being spaced apart from each other along said travel path to provide spaces therebetween for admitting the flow of air into said vacuum chamber from an area generally adjacent to said travel path whereby a differential pressure is created across printed sheets supported by said members as the printed sheets are transferred along said sheet travel path.

16. A method for controlling the movement of freshly printed sheets as they are transferred from the impression cylinder of a printing press along a sheet delivery path to a sheet delivery stacker comprising:

providing subjacent support for the freshly printed sheets by a plurality of elongated support members which are spaced apart from each other along the sheet transfer path;

causing air to flow across the sheet transfer path and through the spaces between the elongated support members thereby imposing a pressure differential across the freshly printed sheets as they are transported along the sheet transfer path; and, controlling the rate at which air is caused to flow across the sheet transfer path.

17. A sheet transfer apparatus for use in combination with a sheet fed, rotary offset printing press of the type having cylinder means for applying wet material to one side of a sheet, and a transfer conveyor having means for gripping and pulling the freshly printed sheet from the cylinder means and conveying the sheet along a transfer path to a further processing station of the press, said sheet transfer apparatus being characterized by:

a frame defining a vacuum chamber having an airflow inlet opening in communication with the vacuum chamber, the airflow inlet opening having an airflow inlet area which is substantially coextensive with a predetermined section of the transfer path;

a plurality of sheet support members mounted on said frame and overlying said airflow inlet opening, said sheet support members being disposed in side-by-side relation and closely spaced across the airflow inlet opening, thereby defining elongated airflow apertures; and, means coupled to said chamber for inducing a partial vacuum within said chamber, whereby suction pressure induced within said chamber causes air to flow into said chamber through the airflow apertures between said support members to draw the unprinted side of a sheet being conveyed along the predetermined section of transfer path toward said support members.

18. A sheet transfer apparatus as set forth in claim 17, further including means for producing differential airflow across the support members in a region overlying a first section of said chamber relative to the suction airflow across the support members in a region overlying a second section of said chamber, the suction airflow volume per unit area into the first chamber section being greater than the suction airflow volume per unit area into the second chamber section.

19. A sheet transfer apparatus for use in combination with a sheet fed, rotary offset printing press of the type having cylinder means for applying wet material to one side of a sheet, and a transfer conveyor having means for gripping and pulling the freshly printed sheet from the cylinder means and conveying the sheet along a transfer path to a further processing station of the press, said sheet transfer apparatus being characterized by:

a frame defining a vacuum chamber having an airflow inlet opening in communication with the vacuum chamber, the airflow inlet opening having an airflow inlet area which is substantially coextensive with a predetermined section of the transfer path;

a plurality of sheet support members mounted on said frame and overlying said airflow inlet opening, said sheet support members being disposed in side-by-side relation and closely spaced across the airflow inlet opening, thereby defining elongated airflow apertures; and, means coupled to said chamber for inducing a partial vacuum within said chamber, whereby suction pressure induced within aid chamber causes air to flow into said chamber through the airflow apertures between said support members to draw the unprinted side of a sheet being conveyed along the predetermined section of transfer path toward said support members.

20. A method of supporting a freshly printed sheet during transfer of the sheet from the impression cylinder of the press characterized by the following steps:

transporting the sheet along a sheet transfer path with the unprinted side of the freshly printed sheet in contact with an array of sheet support members which are spaced apart along the sheet transfer path; and imposing a pressure differential across the sheet as it is transferred along the sheet transfer path by drawing air through elongated inlet apertures defined by adjacent sheet support members, whereby the unprinted side of the sheet is pulled against the support members as the sheet is advanced along the sheet transfer path.

21. A method as set forth in claim 20, including the step:

imposing a greater pressure differential across the sheet during movement of the sheet over a first group of sheet support members than the pressure differential imposed across the sheet during movement of the sheet over a second group of sheet support members, said imposing step being performed by drawing a larger volume of air per unit area through the airflow spaces between the sheet support members of the first group than the volume of air per unit area drawn through the airflow spaces between the sheet support members of the second group.

22. A method as set forth in claim 20, wherein the step of imposing a pressure differential is characterized by the following steps:

installing a vacuum chamber housing member having an airflow inlet opening in communication with a vacuum chamber adjacent the sheet transfer path with the airflow inlet opening being supported in a position facing the sheet transfer path; and, restricting the flow of ambient air into the vacuum chamber housing member by constraining ambient air to flow through elongated airflow apertures defined by an array of elongated support bars which are closely spaced in side-by-side relation over the airflow inlet opening of the vacuum chamber housing member.

* * * * *